United States Patent [19]

Ishikawa et al.

[11] 4,390,611

[45] Jun. 28, 1983

[54] ELECTROPHOTOGRAPHIC PHOTOSENSITIVE AZO PIGMENT CONTAINING MEMBERS

[76] Inventors: Shozo Ishikawa; Kazuharu Katagiri; Katsunori Watanabe; Makoto Kitahara, all c/o Copyer Kabushiki Kaisha, 3-3, Shimorenjaku 6-chome, Mitaka-shi, Tokyo, Japan

[21] Appl. No.: 304,564

[22] Filed: Sep. 22, 1981

[30] Foreign Application Priority Data

| | | | |
|---|---|---|---|
| Sep. 26, 1980 | [JP] | Japan | 55-132965 |
| Oct. 4, 1980 | [JP] | Japan | 55-138263 |
| Oct. 4, 1980 | [JP] | Japan | 55-138264 |
| Oct. 4, 1980 | [JP] | Japan | 55-138265 |
| Oct. 4, 1980 | [JP] | Japan | 55-138266 |
| Nov. 4, 1980 | [JP] | Japan | 55-153814 |
| Nov. 28, 1980 | [JP] | Japan | 55-166557 |
| Jul. 3, 1981 | [JP] | Japan | 56-104856 |
| Jul. 3, 1981 | [JP] | Japan | 56-104857 |
| Jul. 3, 1981 | [JP] | Japan | 56-104858 |

[51] Int. Cl.[3] ..... G03G 5/06; G03G 5/14

[52] U.S. Cl. ..... 430/59; 430/58; 430/72; 430/74; 430/75; 430/76; 430/77; 430/78; 430/79; 260/152; 260/156; 260/157; 260/158; 260/165; 260/164; 260/173; 260/174; 260/177; 260/178; 260/179; 260/172; 260/181; 260/184; 260/194; 260/195; 260/196; 260/199

[58] Field of Search ..... 430/58, 59, 72, 74, 430/75, 76, 77, 78, 79; 260/157

[56] References Cited

U.S. PATENT DOCUMENTS

| | | | |
|---|---|---|---|
| 3,553,189 | 1/1971 | Sugiyama et al. | 260/198 |
| 3,884,691 | 5/1975 | Rochlitz . | |
| 3,898,084 | 8/1975 | Champ et al. . | |
| 3,932,381 | 1/1976 | Haase et al. | 260/157 X |
| 4,024,125 | 5/1977 | Kunstmann et al. . | |
| 4,052,218 | 10/1977 | Hectors . | |
| 4,118,232 | 10/1978 | Piller et al. | 430/74 X |
| 4,150,987 | 4/1979 | Anderson et al. . | |
| 4,251,613 | 2/1981 | Sasaki et al. . | |
| 4,251,614 | 2/1981 | Sasaki et al. . | |
| 4,256,821 | 3/1981 | Enomoto et al. . | |
| 4,260,672 | 4/1981 | Sasaki et al. . | |
| 4,272,598 | 6/1981 | Sasaki et al. . | |
| 4,278,747 | 7/1981 | Murayama et al. . | |
| 4,284,698 | 8/1981 | Kazami et al. . | |
| 4,293,628 | 10/1981 | Hashimoto . | |
| 4,297,426 | 10/1981 | Sakai et al. . | |

FOREIGN PATENT DOCUMENTS

| | | | |
|---|---|---|---|
| 2302522 | 8/1974 | Fed. Rep. of Germany . | |
| 43-16197 | 7/1968 | Japan . | |
| 48-71236 | 9/1972 | Japan . | |
| 51-94829 | 8/1976 | Japan . | |
| 54-2129 | 1/1979 | Japan | 260/157 |
| 54-112637 | 9/1979 | Japan . | |
| 54-119925 | 9/1979 | Japan . | |
| 54-121742 | 9/1979 | Japan . | |
| 55-17105 | 2/1980 | Japan . | |
| 55-82160 | 6/1980 | Japan | 260/157 |
| 55-108667 | 8/1980 | Japan . | |
| 768681 | 2/1957 | United Kingdom | 260/157 |

*Primary Examiner*—Roland E. Martin, Jr.

*Attorney, Agent, or Firm*—Fitzpatrick, Cella, Harper & Scinto

[57] ABSTRACT

An electrophotographic photosensitive member having a photosensitive layer is characterized in that said photosensitive layer contains azo pigments having at least one of azo groups linked to a coupler residue represented by the following formula [1] or [2]:

Formula [1]

Formula [2]

wherein $R_1$ and $R_3$ independently represent hydrogen, substituted or unsubstituted alkyl, substituted or unsubstituted aralkyl, or substituted or unsubstituted aryl, and $R_2$ and $R_4$ independently represent substituted or unsubstituted aryl.

72 Claims, No Drawings

ELECTROPHOTOGRAPHIC PHOTOSENSITIVE AZO PIGMENT CONTAINING MEMBERS

BACKGROUND OF THE INVENTION

1. Field of the Invention

The present invention relates to electrophotographic photosensitive members and more particularly to an electrophotographic photosensitive member containing a specific azo pigment.

2. Description of the Prior Art

As photosensitive members having layers containing organic pigments on a conductive layer known in the art, there are:

(i) a photosensitive member having a layer containing organic pigments dispersed in an insulating binder provided on a conductive layer, as disclosed in Japanese Patent Publication No. 1667/1977 (Electrophotographic plate);

(ii) a photosensitive member having a layer containing organic pigments dispersed in a charge transport medium, comprising a charge transport material or a combination of said material with an insulating binder (binder itself may be a charge transport material), provided on a conductive layer, as disclosed in U.S. Pat. No. 3,894,868 (Electrophotographic plate) and U.S. Pat. No. 3,870,516 (Electrophotographic imaging method);

(iii) a photosensitive member, comprising a conductive layer, cahrge generation layer containing organic pigments and a charge transport layer, as disclosed in U.S. Pat. No. 3,837,851 (Electrophotographic plate);

(iv) a photosensitive member, comprising organic pigments added in a charge-transfer complex, as disclosed in U.S. Pat. No. 3,775,105 (Photoconductive member); and (v) Other types of members While a wide variety of pigments, including phthalocyanine pigments, polycyclic quinone pigments, azo pigments, and quinacridone pigments, have been proposed for use in these photosensitive members, few of them have been actually used.

The reason is that organic photoconductive pigments are generally inferior in sensitivity and durability to inorganic ones such as Se, Cds, and ZnO.

Meanwhile, inorganic photosensitive materials have the following drawbacks:

In selenium base photosensitive members, the crystallization of photosensitive material is readily promoted by heat, moisture, dust, fingerprints, or other factors, remarkably in particular when the atmospheric temperature exceeds about 40° C., resulting in deterioration of the charge bearing characteristics and appearance of white spots in the images. Although the life span of selenium base photosensitive members is said to be as long as about 30–50 thousand copies (in terms of copying capacity per life), the present situation is that many of these elements cannot attain in practice such a life span because the environmental conditions are diversified depending upon the territory and position where the copying machine is set.

Cadmium sulfide base photosensitive members, though having about the same life span as selenium base members, have poor moisture resistance, due to cadmium sulfide itself, which is difficult to overcome, and therefore require some auxiliary means, for example, such as a heater, in order to prevent the moisture absorption.

Zinc oxide base photosensitive members, because they contain a sensitizing dye typified by Rose Bengal, involve the problems of charge deterioration and light fading of the dye, and the life span thereof is at present only about 1000 copies.

Sensitivities of conventional photosensitive members, expressed in exposure quantity for halving original potential, E ½, are in the order of 15 lux·sec for those of unsensitized Se type, 4–8 lux·sec for those of sensitized Se type and of CdS type, and 7–12 lux·sec for those of ZnO type.

Desirable sensitivity of practical photosensitive members are of E ½ value up to 20 lux·sec in the case of ordinary plane paper copying machines and up to 15 lux·sec in the case of high-speed copying machine, though members of lower sensitivity may be used in certain applications.

SUMMARY OF THE INVENTION

An object of this invention is to provide a novel electrophotographic photosensitive member overcoming the drawbacks of conventional inorganic ones and improving those of organic ones even proposed.

Another object of the invention is to provide an excellent electrophotographic photosensitive members having high sensitivity and durability satisfactory for actual use, and additionally solving the problems, occurring in the case of inorganic photosensitive members, of low heat resistance (due to the crystallization of Se), low moisture resistance, light fading, and the like.

A further object of the invention is to provide azo pigments, suitable for organic electrophotographic photosensitive members.

A still further object of the invention is to provide azo pigments, particularly disazo or trisazo pigment, adaptable for the charge generating material used in electrophotographic photosensitive members having charge generation and charge transport layers.

Other objects of the invention will be readily apparent from the following detailed description.

These objects of the invention can be achieved with electrophotographic photosensitive members containing an azo pigment having at least one of azo groups linked with a coupler residue represented by the formula

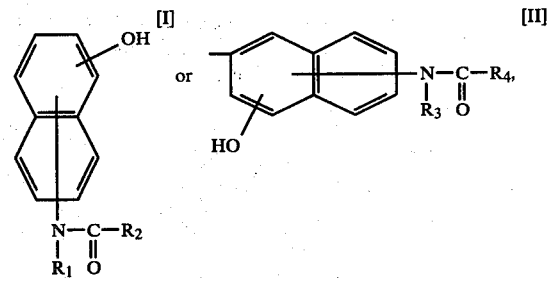

wherein, $R_1$ and $R_3$ represent hydrogen, substituted or unsubstituted alkyl substituted or unsubstituted aralkyl, or substituted or unsubstituted aryl; and $R_2$ and $R_4$ represent substituted or unsubstituted aryl.

DESCRIPTION OF THE PREFERRED EMBODIMENTS

The azo pigments used in the electrophotographic photosensitive members of this invention are those each having at least one, preferably two or three, of azo groups linked with a coupler residue represented by the following formula [I] or [II]:

[I]

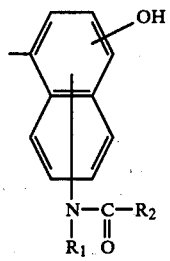

[II]

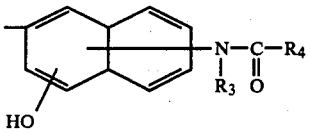

In these formulas, $R_1$ and $R_3$ represent hydrogen, substituted or unsubstituted alkyl (e.g., methyl, ethyl, n-propyl, isopropyl, n-butyl, sec-butyl, t-butyl, n-amyl, t-amyl, n-octyl, 2-ethylhexyl, t-octyl, 2-methoxyethyl, 3-methoxypropyl, 2-chloroethyl, 3-chloropropyl, or 2-hydroxyethyl), substituted or unsubstituted aralkyl (e.g., benzyl, phenethyl, chlorobenzyl, dichlorobenzyl, methylbenzyl, ethylbenzyl, methoxybenzyl, α-naphthylmethyl, or β-naphthylmethyl), or substituted or unsubstituted aryl (e.g., phenyl, tolyl, xylyl, biphenyl, chlorophenyl, dichlorophenyl, trichlorophenyl, nitrophenyl, cyanophenyl, methoxyphenyl, dimethyoxyphenyl, dichloromethoxyphenyl, α-naphthyl, or β-naphthyl); and $R_2$ and $R_4$ represent unsubstituted aryl (e.g., pheny, α-naphthyl, or β-naphthyl) or substituted aryl, of which substituent includes alkyl (e.g. methyl, ethyl, n-propyl, isopropyl, n-butyl, sec-butyl, t-butyl, and the like), alkoxy (e.g., methoxy, ethoxy, propoxy, butoxy, and the like), dialkylamino (e.g., dimethylamino, diethylamino, dipropylamino, dibutylamino, dibenzylamino, and the like), diarylamino (e.g., diphenylamino, ditolylamino, dixylylamino, and the like), halogen (e.g., chlorine, bromine, iodine, etc.), nitro, cyano, and the like.

The disazo and trisazo pigments usable in this invention can be represented by the following formulas, (1) or (3) and (2) or (4), respectively:

Formula (1)

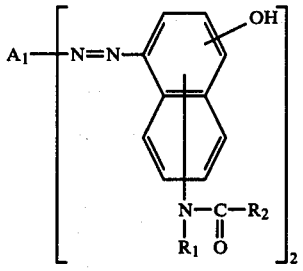

-continued

Formula (2)

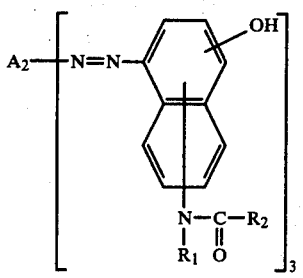

Formula (3)

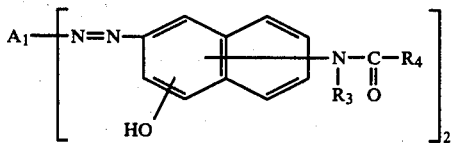

Formula (4)

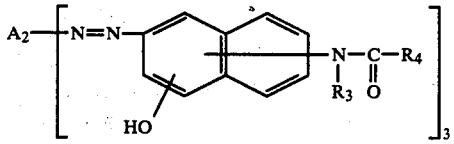

In these formula, $R_1$, $R_2$, $R_3$, and $R_4$ are as defined above, $A_1$ is a divalent organic radical, and $A_2$ is a trivalent organic radical. As examples of $A_1$ and $A_2$, there may be cited (a) a hydrocarbon radical having at least one benzene ring, (b) a nitrogen-containing hydrocarbon radical having at least two benzene rings, and (c) a hydrocarbon radical having at least two benzene rings and at least one hetero ring.

Each benzene ring in the above (a) and (b) may also form a condensed-ring together with one or more other benzene rings, and a benzene ring in the above (c) may also form a condensed-ring together with one or more other benzene rings or with one or more hetero rings.

The above hydrocarbon radical (a), nitrogen-containing hydrocarbon radical (b), and hydrocarbon radical (c) each can be substituted by a suitable atom, for example, halogen (chlorine, bromine, or iodine); an organic radical, for example, alkyl (methyl, ethyl, n-propyl, isopropyl, n-butyl, t-butyl, and the like), alkoxy (methoxy, ethoxy, propoxy, butoxy, and the like), dialkylamino (dimethylamino, diethylamino, dipropylamino, dibutylamino, dibenzylamino, and the like), diarylamino (diphenylamino, ditolylamino, dixylylamino, and the like), acylamino (acetylamino, propionylamino, butylylamino, benzoylamino, toluoylamino, and the like); nitro group; hydroxyl group; and the like.

More specifically, (a) is, for example, as follows:

(1)

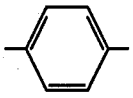

(2)

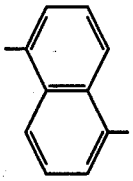

-continued (3)

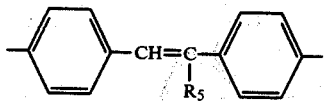

(4)

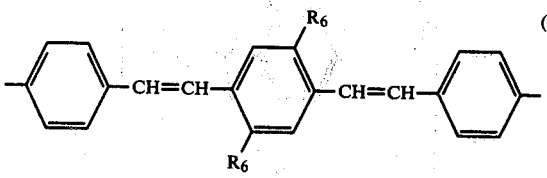

(5)

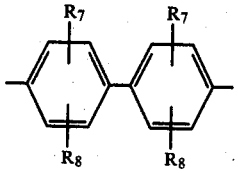

Wherein $R_5$ is hydrogen or cyano radical, $R_6$ is hydrogen or alkoxy radical such as methoxy, ethoxy, propoxy, butoxy, and the like, and $R_7$ and $R_8$ are hydrogen; halogen such as chlorine, bromine, or iodine; alkyl such as methyl, ethyl, propyl, isopropyl, n-butyl, t-butyl, and the like; alkoxy such as methoxy, ethoxy, propoxy, butoxy, and the like; or nitro radical, in which $R_7$ and $R_8$ are the same or different and may also be positioned symmetrically relating to the benzene ring.

Examples of (b) are as follows:

(1)

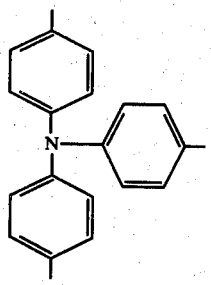

(2)

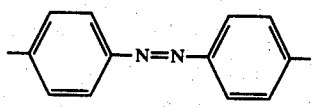

(3)

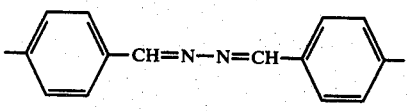

The following are examples of (c):

(1)

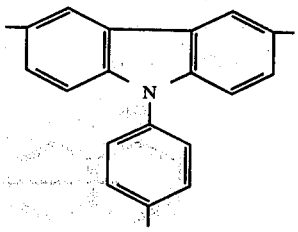

-continued (2)

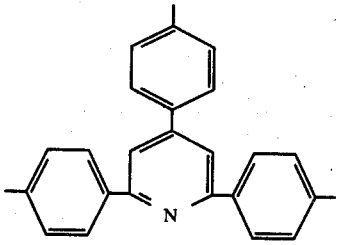

(3)

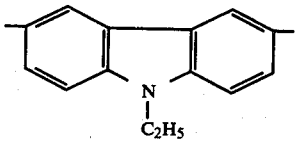

(4)

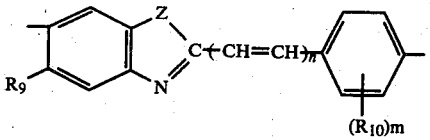

(5)

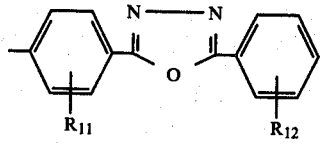

(6)

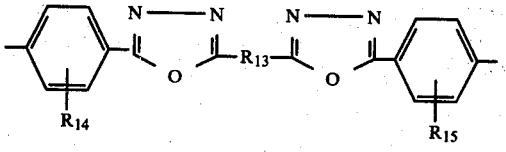

(7)

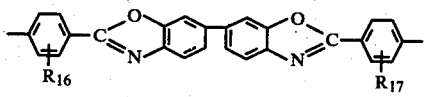

(8)

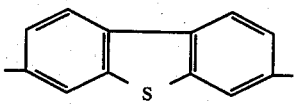

(9)

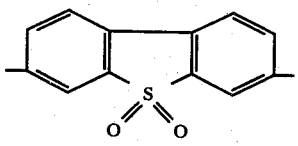

(10)

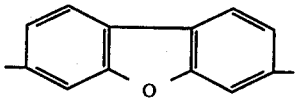

In the above formulas;

Z is oxygen, sulfur, or $>N-R_{18}$, wherein $R_{18}$ is hydrogen or lower alkyl (e.g., methyl, ethyl, n-propyl, iso-propyl, n-butyl, or t-butyl); $R_9$ is hydrogen, halogen (e.g., chlorine, bromine, or iodine), or lower alkyl (e.g., methyl, ethyl, n-propyl, isopropyl, n-butyl, or t-butyl); $R_{10}$ is hydrogen, halogen (e.g., chlorine, bromine, or iodine), lower alkyl (e.g., methyl, ethyl, n-propyl, isopropyl, n-butyl, or t-butyl), alkoxy (e.g., methoxy, ethoxy, propoxy, or butoxy), hydroxyl, nitro, dialkylamino (e.g., dimethylamino, diethylamino, or dipropylamino), or acylamino (e.g., acetylamino, propionylamino, butyrylamino, benzoylamino, or toluoylamino); n is 0 or 1; m is an integer of 1–4;

$R_{11}$ and $R_{12}$, which may be the same or different, represent hydrogen, lower alkyl (e.g., methyl, ethyl, n-propyl, isopropyl, n-butyl, or t-butyl), or halogen (e.g., chlorine, bromine, or iodine);

$R_{13}$ represents merely a single bond (a direct bond between two heterorings), substituted or unsubstituted phenylene, or substituted or unsubstituted vinylene, wherein the substituent includes halogen (e.g., chlorine, bromine, and iodine), lower alkyl (e.g., methyl, ethyl, n-propyl, isopropyl, n-butyl, and t-butyl), alkoxy (e.g., methoxy, ethoxy, propoxy, and butoxy), and cyano; $R_{14}$ and $R_{15}$, which may be the same or different, represent hydrogen, halogen (e.g., chlorine, bromine, or iodine), or lower alkyl (e.g., methyl, ethyl, n-propyl, isopropyl, n-butyl, or t-butyl); and $R_{16}$ and $R_{17}$, which may be the same or different, represent hydrogen, halogen (e.g., chlorine, bromine, or iodine), lower alkyl (e.g., methyl, ethyl, n-propyl, isopropyl, n-butyl, or t-butyl), alkoxy (e.g., methoxy, ethoxy, propoxy, or butoxy), nitro, or acetylamino (e.g., acetylamino, propionylamino, butyrylamino, benzoylamino, or toluoylamino).

More particularly, preferred examples of the azo pigments used in this invention are the disazo and trisazo pigments represented by the following formulas:

(1)'

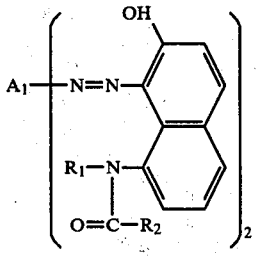

(2)'

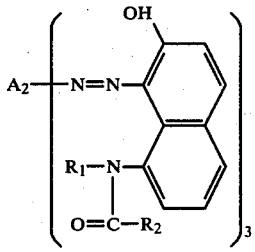

(1)''

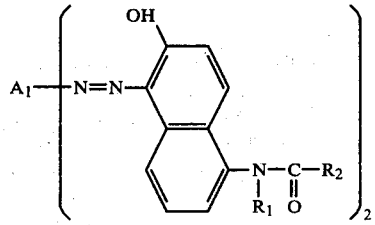

-continued (2)''

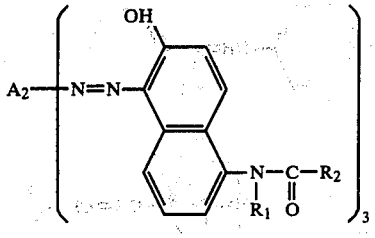

(3)'

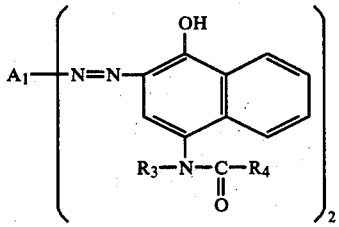

(4)'

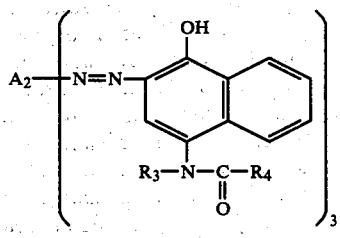

wherein $A_1$, $A_2$, $R_1$, $R_2$, $R_3$, and $R_4$ are as defined above.

Individual examples of the pigments used in this invention will be apparent from the examples stated later.

These pigments can be easily prepared, for instance, by tetrazotization or hexazotization of a starting compound, an amine represented by the formula $A_1$-($NH_2$)$_2$ or $A_2$-($NH_2$)$_3$, wherein $A_1$ and $A_2$ are as defined above, by the usual method, followed by coupling with a coupler in the presence of an alkali, said coupler being represented by the formula

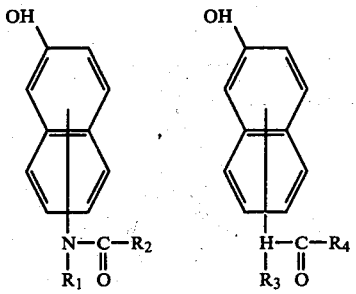

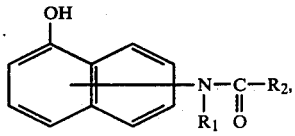

or

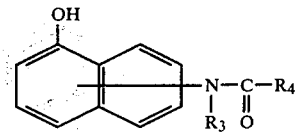

($R_1$, $R_2$, $R_3$, and $R_4$ are as defined above), or these pigments can be prepared by isolating once the tetrazonium or hexazonium salt of said amine in the form of borofluoride or of zinc chloride salt, followed by coupling with said coupler in the presence of an alkali in a suitable solvent such as, for example, N,N-dimethylformamide or dimethylsulfoxide.

The electrophotographic photosensitive member of this invention is characterized by having a photosensitive layer which contains an azo pigment, and can be applied accordingly to any of the above-mentioned types of photosensitive members, (i)-(v). However, it is desirable to be used as a photosensitive member of type (ii), (iii), or (iv), in order to enhance the charge-transporting efficiency of charge-carriers generated by light absorption of the azo pigment according to this invention.

Further, the application to type (iii) is most desirable in view of full utilization of beneficial properties of said pigment.

Therefore, the electrophotographic photosensitive member of this type, (iii), according to this invention will be described below in more detail.

Layers constituting the member include a conductive layer, charge generation layer, and charge transport layer. The charge generation layer may be laid either above or below the charge transport layer, but the lamination in the order of the conductive layer, charge generation layer, and charge transport layer from bottom to top is preferred for a repeated use type of electrophotographic photosensitive member, in consideration mainly of the mechanical strength and, in certain case, of the charge bearing characteristics. A bond layer may be laid between the conductive layer and charge transport layer, if required, for the purpose of improving the adhesion between them.

For the conductive layer, there may be used a plate or foil of metal such as aluminum, a plastic film onto which a metal such as aluminum is metallized by vacuum deposition, a paper or plastic film each overlaid with aluminum foil, a conductivized paper, and the like.

Effective materials used for the bond layer are casein, poly (vinyl alcohol), water-soluble ethylene-acrylic acid copolymer, nitrocellulose, and hydroxypropylcellulose, etc. Tickness of the bond layer is 0.1–5$\mu$, preferably 0.5–3$\mu$.

Said azo pigment, after finely divided, is coated on the conductive layer or on the bond layer covering it, without using a binder or if necessary, after dispersed in a suitable binder solution, and then the coating is dried.

For the pulverization of the pigment, the known means such as a ball mill or an attritor can be employed. The pigment particle size is up to 5$\mu$, preferably up to 2$\mu$, and most preferably up to 0.5$\mu$.

Said azo pigment can be coated by using a solution which the pigment is dissolved in an amine solvent such as ethylenediamine.

The usual coating methods such as using blade or Meyer bar, spraying, soaking, and the like are used for the pigment coating.

Thickness of the charge generation layer is up to 5$\mu$, preferably 0.01–1$\mu$. The binder content in the charge generation layer is up to 80%, preferably up to 40%, by weight since higher binder contents have an adverse effect on the sensitivity.

Many kinds of resins can be used as the binder, including poly (vinyl butyrals), poly (vinyl acetates), polyesters, polycarbonates, phenoxy resins, acrylic resins, polyacrylamides, polyamides, poly (vinylpyridine) resins, cellulosic resins, urethane resins, epoxy resins, casein, poly (vinyl alcohols), and the like.

The charge generation layer thus formed is overlaid with the charge transport layer.

When the charge-transport material does not have film forming ability in itself, the charge transport layer is formed by applying and then drying in the usual way a dispersion of said material in a solution prepared by dissolving a binder in a suitable organic solvent.

The usable charge-transport materials are classified as electron-transporting materials and hole-transporting materials.

The usuable electron-transporting materials include the following electron attractive substances and polymers thereof: chloranil, bromanil, tetracyanoethylene, tetracyanoquinodimethane, 2,4,7-trinitro-9-fluorenone, 2,4,5,7-tetranitrofluorenone, 2,4,7-trinitro-9-dicyanomethylenefluorenone, 2,4,5,7-tetranitroxanthone, and 2,4,8-trinitrothioxanthone.

The suited hole-transporting materials include the following compounds:

Hydrazone compounds

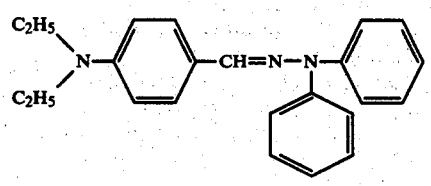

(1)

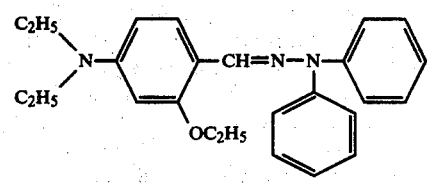

(2)

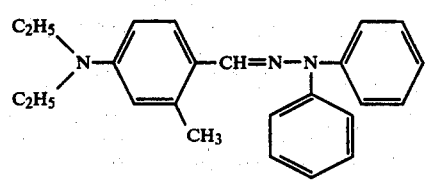

(3)

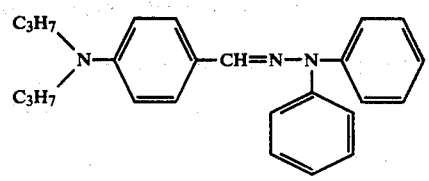

(4)

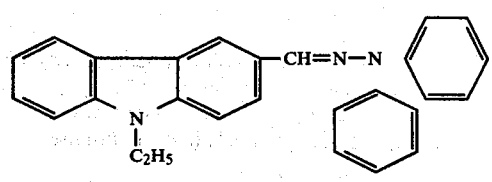

(5)

-continued (6)

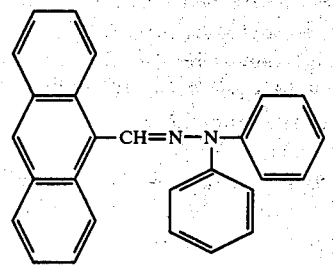

(7)

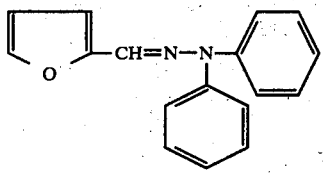

Pyrazoline compounds (1) 1-phenyl-3-(4-N,N-diethylaminostyryl)-5-(4-N,N-diethylaminophenyl)pyrazoline
(2) 1-phenyl-3-(4-N,N-dipropylaminostyryl)-5-(4-N,N-diethylaminophenyl)pyrazoline
(3) 1-phenyl-3-(4-N,N-dibenzylaminostyryl)-5-(4-N,N-dibenzylaminophenyl)pyrazoline
(4) 1-[pyridyl-(2)]-3-(4-N,N-diethylaminostyryl)-5-(4-N,N-diethylaminophenyl)pyrazoline
(5) 1-[pyridyl-(3)]-3-(4-N,N-diethylaminostyryl)-5-(4-N,N-diethylaminophenyl)pyrazoline
(6) 1-[quinolyl-(2)]-3-(4-N,N-diethylaminostyryl)-5-(4-N,N-diethylaminophenyl)pyrazoline
(7) 1-[quinolyl-(4)]-3-(4-N,N-diethylaminostyryl)-5-(4-N,N-diethylaminophenyl)pyrazoline
(8) 1-[3-methoxypyridyl-(2)]-3-(4-N,N-diethylaminostyryl)-5-(4-N,N-diethylaminophenyl)pyrazoline
(9) 1-[lepidyl-(2)]-3-(4-N,N-diethylaminostyryl)-5-(4-N,N-diethylaminophenyl)pyrazoline
(10) 1-phenyl-3-(4-N,N-diethylaminostyryl)-4-methyl-5-(4-N,N-diethylaminophenyl)pyrazoline
(11) 1-phenyl-3-(α-methyl-4-N,N-diethylaminostyryl)-5-(4-N,N-diethylaminophenyl)pyrazoline Diarylalkanes (1) 1,1-bis(4-N,N-dimethylaminophenyl)propane
(2) 1,1-bis(4-N,N-diethylaminophenyl)propane
(3) 1,1-bis(4-N,N-diethylamino-2-methylphenyl)propane
(4) 1,1-bis(4-N,N-diethylamino-2-methoxyphenyl)propane
(5) 1,1-bis(4-N,N-dibenzylamino-2-methoxyphenyl)-2-methylpropane
(6) 1,1-bis(4-N,N-diethylamino-2-methylphenyl)-2-phenylpropane
(7) 1,1-bis(4-N,N-diethylamino-2-methylphenyl)heptane
(8) 1,1-bis(4-N,N-dibenzylamino-2-methylphenyl)-1-cyclohexylmethane
(9) 1,1-bis(4-N,N-dimethylaminophenyl)pentane
(10) 1,1-bis(4-N,N-dibenzylaminophenyl)n-butane Triaryl alkanes (1) 1,1-bis(4-N,N-dimethylaminophenyl)-1-phenylmethane
(2) 1,1-bis(4-N,N-diethylaminophenyl)-1-phenylmethane
(3) 1,1-bis(4-N,N-diethylamino-2-methylphenyl)-1-phenylmethane
(4) 1,1-bis(4-N,N-diethylamino-2-ethylphenyl)-2-phenylethane
(5) 1,1-bis(4-N,N-diethylamino-2-methylphenyl)-3-phenylpropane
(6) 1,1-bis(4-N,N-diethylamino-2,5-dimethoxyphenyl)-3-phenylpropane Oxadiazole compounds (1) 2,5-bis(4-N,N-dimethylaminophenyl)-1,3,4-oxadiazole
(2) 2,5-bis(4-N,N-diethylaminophenyl)-1,3,4-oxadiazole
(3) 2,5-bis(4-N,N-dipropylaminophenyl)-1,3,4-oxadiazole
(4) 2,5-bis(4-N,N-dibenzylaminophenyl)-1,3,4-oxadiazole
(5) 2-methyl-5-(3-carbazolyl)-1,3,4-oxadiazole
(6) 2-ethyl-5-(3-carbazolyl)-1,3,4-oxadiazole
(7) 2-ethyl-5-(9-ethyl-3-carbazolyl)-1,3,4-oxadiazole
(8) 2-N,N-diethylamino-5-(9-ethyl-3-carbazolyl)-1,3,4-oxadiazole
(9) 2-styryl-5-(3-carbazolyl)-1,3,4-oxadiazole Anthracene compounds (1) 9-styrylanthracene
(2) 9-(4-N,N-dimethylaminostyryl)anthracene
(3) 9-(4-N,N-diethylaminostyryl)anthracene
(4) 9-(4-N,N-dibenzylaminostyryl)anthracene
(5) 4-bromo-9-(4-N,N-diethylaminostyryl)anthracene
(6) α-(9-anthryl)-β-(3-carbazolyl)ethylene
(7) α-(9-anthryl)-β-(9-ethyl-3-carbazolyl)ethylene Oxazole compounds (1) 2-(4-N,N-diethylaminophenyl)-4-(4-N,N-dimethylaminophenyl)-5-(2-chlorophenyl)oxazole
(2) 2-(4-N,N-diethylaminophenyl)-5-phenyloxazole
(3) 4-(4-N,N-dimethylaminophenyl)-5-(2-chlorophenyl-)oxazole
(4) 2-(4-N,N-dimethylaminophenyl)-4,5-diphenyloxazole
(5) 2-(4-N,N-dimethylaminophenyl)-4-(4-N,N-diethylaminophenyl)-5-(2-chlorophenyl)oxazole
(6) 2,5-di-(2-chlorophenyl)-4-(4-N,N-diethylaminophenyl)oxazole Other compounds and polymers: pyrene, N-ethylcarbazole, triphenylamine, poly (N-vinylcarbazole), halogenated poly (N-vinylcarbazole), polyvinylpyrene, polyvinylanthracene, polyvinylacrydine, poly (9-vinylphenylanthracene), pyrene-formaldehyde resin, ethylcarbazole-formaldehyde resin The charge-transport materials usable in this invention are not limited to the compounds enumerated above, and they can be used separately or in combination. However, when an electron-transporting material and a hole-transporting material are mixed together, it can occur that a charge-transport absorption appears in the visible region and the incident light does not reach the charge generation layer lying under the charge transport layer upon exposing the photosensitive member to light. Thickness of the charge transport layer is 5–30μ, preferably 8–20μ.

The binders usable in the charge transport layer are, for example, acrylic resins, polystyrenes, polyesters, and polycarbonates. A hole-transporting polymer such as poly (N-vinylcarbazole), mentioned above, can be used as a binder for hole-transporting low-molecular materials, whereas such polymer of electron-transporting monomer as disclosed in U.S. Pat. No. 4,122,113 can be used as a binder for electron-transporting low-molecular materials.

When there is used a photosensitive member prepared by lamination in the order of a conductive layer, charge generation layer, and charge transport layer wherein the charge-transporting material comprises an electron-transporting material, the surface of the charge transport layer is required to be positively charged. By exposure of the charged surface to a pattern of light, electrons generated in the exposed areas of the charge generation layer are injected into the charge transport layer, then reach the surface, and neutralize positive charges to decay the surface potential, thus resulting in an electrostatic contrast between exposed and unexposed areas. The latent images thus produced are developed with a negatively chargeable toner to form visible images. The visible toner images can be fixed directly or after transferred to paper, plastic film, or the like. Further, the latent electrostatic image on the photosensitive member can also be transferred onto the insulating layer of a transfer paper and then developed and fixed. The developer, developing method, or fixing method in these operations is not limited to a specific one: known developers and known developing and fixing methods can be adopted.

On the other hand, when the charge-transport material comprises a hole-transporting material, the surface of the charge transport layer is required to be negatively charged. By exposure of the charged surface to a pattern of light, holes generated in the exposed areas of the charge generation layer are injected into the charge transport layer, then reach the surface, and neutralize negative charges to decay the surface potential, thus resulting in an electrostatic contrasts between exposed and unexposed areas. For the developing, contrary to the case where an electron-transporting material is used, a positively chargeable toner is required to be used.

This invention can be effectively applied to photosensitive members of other types than type (iii) stated above in detail. For example, when the present invention is applied to a photosensitive member of type (i), an azo pigment represented by formula (I) is added to a solution of such an insulating binder as used in the charge transport layer of a photosensitive member of type (iii), and the resultant pigment dispersion is coated onto the surface of a conductive support and dried. Thus, a photosensitive member of type (i) is obtained.

A photosensitive member of type (ii) according to this invention is obtained in the following way: An insulating binder for use in charge-transport materials of photosensitive members of type (iii) and the charge transport layers of these members is dissolved in a suitable solvent and the above-mentioned azo pigments of this invention are added to this binder solution, dispersed, coated on the surface of a conductive support, and dried.

Since a charge-transfer complex is formed by combining the electron-transporting material and hole-transporting material, which are mentioned referring to the photosensitive member of type (iii), a photosensitive member of type (iv) can be obtained by adding azo pigments of the present invention to a solution of the charge-transfer complex, dispersing the pigment, coating then the pigment dispersion on the surface of a conductive support, and drying it.

In any type of photosensitive members, at least one azo pigment of this invention can be contained, and said pigment can also be used in combination with another pigment of different light absorption for enhancing the sensitivity, with one or more other azo pigments of this invention for obtaining a panchromatic photosensitive member, or with a charge generation material selected from known dyes and pigments.

The electrophotographic photosensitive members of this invention can be utilized not only for electrophotographic copying machines but also widely in application fields of electrophotography such as those of laser printer, CRT printer, etc.

The synthetic process for azo pigments used in this invention will be illustrated by the following examples:

SYNTHETIC PROCESS EXAMPLE 1

Synthesis of the following:

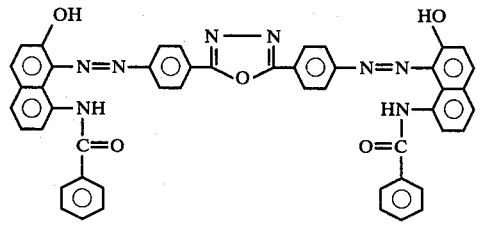

A dispersion of 2.74 g (0.011 mol) of 2,5-di(p-aminophenyl)-1,3,4-oxadiazole, 6.3 g (0.071 mol) of concentrated hyrochloric acid, and 34 ml of water was cooled to 6° C., and a solution of 1.57 g (0.023 mol) of sodium nitrite in 5 ml of water was added dropwise over 40 minutes while keeping the temperature at 4°–6° C. Stirring for further 25 minutes at the same temperature gave a tetrazonium liquid. To a solution prepared by dissolving 4.0 g (0.1 mol) of caustic soda and 6.0 g (0.023 mol) of 8-benzamino-2-naphthol in 300 ml water, was added dropwise the above tetrazonium liquid during 12 minutes while keeping the temperature of the solution at 4°–6.5° C. Stirring was continued for further 3 hours and then the mixture was allowed to stand overnight at room temperature. The resulting liquid was filtered and the obtained pigment was washed with water and then with acetone and dried, giving 8.5 g of crude pigment (crude yield from the starting diamine compound was 97%). The crude pigment was then washed five times with each 400 ml hot N,N-dimethylformamide and then once with hot acetone. Through drying it, 5.85 g of purified pigment was obtained.

Yield (based on the starting diamine): 67%.

Decomposition point: ≧300° C.

Visible spectrum: 553 nm (O-dichlorobenzene soln.).

IR absorption spectrum: 1675 $m^{-1}$ (amide).

SYNTHETIC PROCESS EXAMPLE 2

Synthesis of the following:

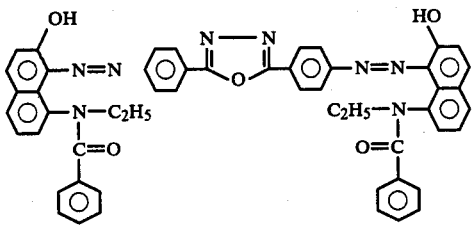

(No. 12)

A dispersion of 4.52 g (0.0179 mol) of 2,5-di(p-aminophenyl)-1,3,4-oxadiazole, 10.0 ml of concentrated hydrochloric acid, and 55 ml of water was cooled to 4° C., and a solution of 3.60 g (0.0376 mol) of sodium nitrite in 9 ml of water was added dropwise during 15 minutes. Further stirring at 3°-6° C. for 30 minutes, addition of active carbon, and filtration gave a tetrazonium aqueous solution.

To a solution prepared by dissolving 17.8 g of sodium hydroxide and 11.5 g (0.0395 mol) of 8-(ethylbenzoylamino) naphthol-2 in 380 ml of water, was added dropwise the above tetrazonium solution at 6°-8° C. over 30 minutes. After stirring for further 2 hours and standing overnight at room temperature, the resulting liquid was filtered. The obtained pigment was washed with water and then with acetone and dried, giving 13 g of crude pigment. The pigment was washed with N,N-dimethylformamide and tetrahydrofuran successively and dried, giving 10.8 g of purified pigment.

Yield (based on the starting diamine): 70.3%.

Decomposition point: ≧300° C.

| Elemental analysis, for $C_{52}H_{40}N_8O_5$: | | |
|---|---|---|
| | Calcd. (%) | Found (%) |
| C | 72.87 | 72.58 |
| H | 4.71 | 4.87 |
| N | 13.08 | 13.02 |

IR absorption spectrum: 1645 $cm^{-1}$ (t-amide).

SYNTHETIC PROCESS EXAMPLE 3

Synthesis of the following:

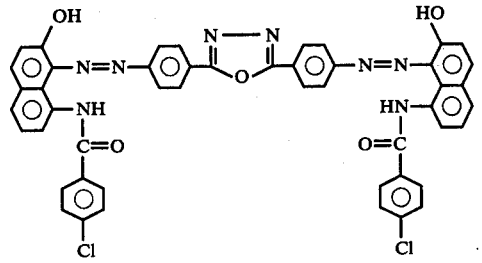

(No. 30)

A dispersion consisting of 3.28 g (0.013 mol) of 2,5-di(p-aminophenyl)-1,3,4-oxasadiazole, 7.5 ml of concentrated hydrochloric acid, and 40 ml of water was cooled to 4° C., and a solution of 1.90 g (0.0273 mol) of sodium nitrite in 6 ml of water was added dropwise during 10 minutes. Stirring for further 30 minutes at 4°-6° C., addition of active carbon, and filtration gave a tetrazonium solution.

Then, to a solution prepared by dissolving 11 g of sodium hydroxide and 8.13 g (0.0273 mol) of 8-(4-chlorobenzamino)-naphthol-2 in 400 ml of water, was added dropwise the above tetrazonium solution at 5°-8° C. spending 30 minutes. After stirring for further 2 hours and standing overnight at room temperature, the mixture was filtered. The obtained pigment was washed with water and then with acetone and dried, giving 10.0 g of crude pigment. The crude pigment was further washed with N,N-dimethylformamide and tetrahydrofuran successively and dried, giving 8.6 g of purified pigment.

Yield (based on the starting diamine): 76%.

Decomposition point: ≧300° C.

| Elemental analysis, for $C_{48}H_{30}Cl_2N_8O_5$: | | |
|---|---|---|
| | Calcd. (%) | Found (%) |
| C | 66.28 | 66.08 |
| H | 3.48 | 3.65 |
| N | 12.89 | 12.76 |

IR absorption spectrum: 1675 $cm^{-1}$ (sec.-amide).

SYNTHETIC PROCESS EXAMPLE 4

Synthesis of the following:

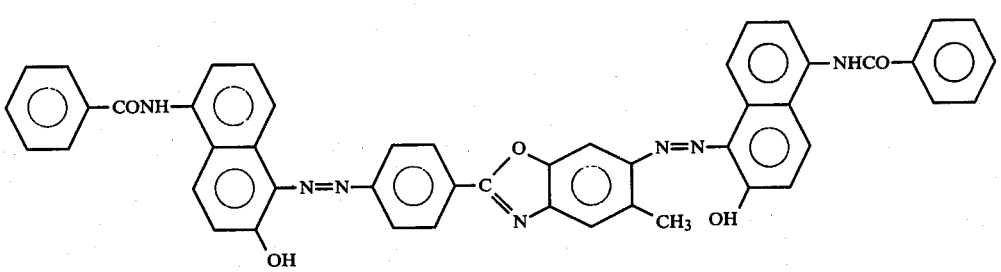

(No. 58)

A dispersion consisting of 6.22 g (0.026 mol) of 2-(p-aminophenyl)-5-methyl-6-aminobenzoxasole, 32 ml of concentrated hydrochloric acid, and 50 ml of water was cooled to 4° C., and a solution of 3.77 g (0.0546 mol) of sodium nitrite in 13 ml of water was added dropwise during 15 minutes. Stirring for further 30 minutes at 3°-5° C., addition of active carbon, and filtration gives a tetrazonium solution.

Then, to a solution prepared by dissolving 24 g of sodium hydroxide and 15.1 g (0.057 mol) of 5-benzamino-2-naphthol in 680 ml of water, was added dropwise the above tetrazonium solution at 5°–10° C. over 30 minutes. After stirring for further 2 hours and standing overnight at room temperature, the mixture was filtered. The obtained pigment was washed with water and then with acetone and dried, giving 16.5 g of crude pigment. The pigment was further washed with N,N-dimethylformamide and tetrahydrofuran successively and dried, giving 14.7 g of purified pigment.

Yield (based on the starting diamine): 72%.

Decomposition point: ≧300° C.

| Elemental analysis, for $C_{48}H_{33}N_7O_5$: | | |
|---|---|---|
| | Calcd. (%) | Found (%) |
| C | 73.17 | 73.08 |
| H | 4.23 | 4.14 |
| N | 12.45 | 12.53 |

IR absorption spectrum: 1670 $cm^{-1}$ (sec-amide).

Other azo pigments of this invention can also be synthesized in a similar way to that described in the above four pigments.

This invention will be illustrated in more detail by the following examples:

EXAMPLE 1

A solution of casein in aqueous ammonia (11.2 g of casein, 1 g of 28% aqueous ammonia, 222 ml of water) was coated on an aluminum plate by means of a Meyer bar and dried to form a bond layer of 1.0 g/$m^2$. Subsequently, 5 g of pigment No. 1 was dispersed in a solution of 2 g of poly (vinyl butyral) resin (degree of butyral conversion 63 mol %) in 95 ml of ethanol by means of a ball mill, and the dispersion was coated on the bond layer using a Meyer bar to form a charge generation layer of 0.2 g/$m^2$ after drying.

A solution prepared by dissolving 5 g of 1-phenyl-3-(4-N,N-diethylaminostyryl)-5-(4-N,N-diethylaminophenyl) pyrazoline and 5 g of poly[2,2-bis(4-hydroxyphenyl)propane carbonate]-i.e., poly (bisphenol A carbonate), hereinafter, referred to simply as polycarbonate-(M.W. about 30,000) in 70 ml of tetrahydrofuran was coated on the charge generation layer to form a charge transport layer of 10 g/$m^2$ after drying.

The electrophotographic photosensitive member thus prepared was conditioned at 20° C. under 65% relative humidity, then subjected to corona charge at ⊖5 KV in static fashion using an electrostatic copying paper test device (Model SP-428, made by Kawaguchi Denki K.K.), retained in the dark for 10 seconds, and then exposed to light at 5 lux to measure its charge bearing characteristics. The results were as follows, wherein Vo (−V) is original potential, Vk (%) is potential retention ratio after standing for 10 seconds in a dark place, and E ½ is exposure quantity for halving original potential.

Vo: ⊖500 V; Vk: 80%; E ½: 6.1 lux·sec.

EXAMPLES 2–8

A dispersion of 5 g of each azo pigment represented by the foregoing formula (1)', wherein $A_1$, $R_1$, and $R_2$ are shown in Table 1, 10 g of a polyester resin solution (trade name: Polyester Adhesive 49,000, made by Du Pont Co., 20% solids), and 80 ml of tetrahydrofuran was prepared by using a ball mill and coated on the surface of aluminum vacuum deposited on a Mylar film, using a Meyer bar to form a charge generation layer of 0.20 g/$m^2$ after drying.

The same solution for forming a charge transport layer as used in Example 1 was coated on the charge generation layer using a Baker applicator to give a dry film thickness of 10 g/$m^2$.

Charge bearing characteristics of the photosensitive members prepared in this way were measured according to the prescribed method described in Example 1.

Structures of pigments used and charge bearing characteristics of the photosensitive members are shown in Tables 1 and 2, respectively.

TABLE 1

| Example No. | Pigment No. | Structure of pigment used: Azo pigment represented by formula (1)' $A_1$ | $R_1$ | $R_2$ |
|---|---|---|---|---|
| 2 | 2 | 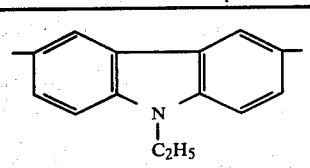 | —H | 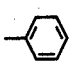 |
| 3 | 3 | 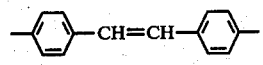 | —H | 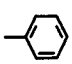 |
| 4 | 4 | 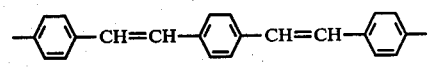 | —H | 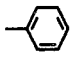 |
| 5 | 5 | 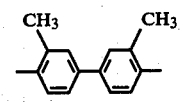 | —H | 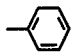 |
| 6 | 6 | 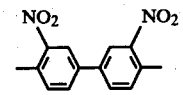 | —H | 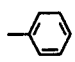 |

TABLE 1-continued

| Example No. | Pigment No. | Structure of pigment used: Azo pigment represented by formula (1)' $A_1$ | $R_1$ | $R_2$ |
|---|---|---|---|---|
| 7 | 7 | 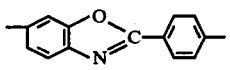 | —H | 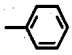 |
| 8 | 8 | 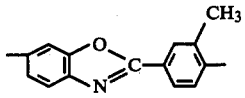 | —H | 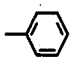 |

TABLE 2

| Example No. | Charge bearing characteristics: Vo (−V) | Vk (%) | E ½ (lux.sec) |
|---|---|---|---|
| 2 | 510 | 88 | 8.8 |
| 3 | 550 | 90 | 6.0 |
| 4 | 540 | 89 | 4.8 |
| 5 | 560 | 88 | 8.8 |
| 6 | 570 | 91 | 8.9 |
| 7 | 540 | 89 | 6.0 |
| 8 | 550 | 90 | 5.9 |

EXAMPLES 9–11

A dispersion of 5 g of each azo pigment represented by the foregoing formula (2)', wherein $A_2$, $R_1$, and $R_2$ are shown in Table 3, 10 g of the same polyester solution as used in Examples 2–8, and 80 ml of tetrahydrofuran was prepared by using a ball mill and coated on the surface of aluminum vacuum deposited on a Mylar film using a Meyer bar to form a charge generation layer of 0.20 g/m$^2$ after drying.

The same solution for forming a charge transport layer as used in Example 1 was coated on the charge generation layer using a Baker applicator to give a dry film thickness of 10 g/m$^2$. Measurements of charge bearing characteristics of the photosensitive members thus prepared were made according to the prescribed method.

Table 3 shows structures of the pigments used and Table 4 the measured charge bearing characteristics.

TABLE 3

| Example No. | Pigment No. | Structure of pigment used: Azo pigment represented by formula (2)' $A_2$ | $R_1$ | $R_2$ |
|---|---|---|---|---|
| 9 | 9 | 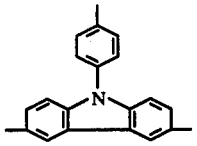 | —H | 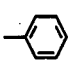 |
| 10 | 10 | 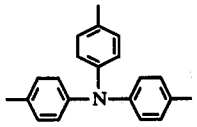 | —H | 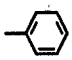 |

TABLE 3-continued

| Example No. | Pigment No. | Structure of pigment used: Azo pigment represented by formula (2)' $A_2$ | $R_1$ | $R_2$ |
|---|---|---|---|---|
| 11 | 11 | 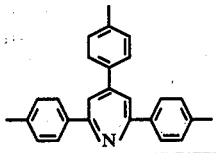 | —H | 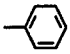 |

TABLE 4

| Example No. | Charge bearing characteristics: Vo (−V) | Vk (%) | E ½ (lux.sec) |
|---|---|---|---|
| 9 | 530 | 89 | 8.5 |
| 10 | 550 | 90 | 9.0 |
| 11 | 560 | 91 | 11.2 |

EXAMPLE 12

To a solution prepared by dissolving 5 g of 2,5-bis(4-N,N-diethylaminophenyl)-1,3,4-oxadiazole and 5 g of poly (N-vinylcarbazole) (M.W. about $3\times10^5$) in 70 ml of tetrahydrofuran was added 1.0 g of pigment No. 5 in Table 1. The mixture was dispersed in a ball mill and then coated on the casein layer of the same casein-coated aluminum plate as used in Example 1, using a Meyer bar to give a dry film thickness of 9.5 g/m$^2$.

Charge bearing characteristics of the photosensitive member thus prepared were measured according to the prescribed method, except for charging the member positively. The results were as follows:

Vo: ⊕490 V; Vk: 83%; E½: 14 lux·sec.

EXAMPLE 13

An aqueous solution of poly (vinyl alcohol) was coated on an aluminum plate of 100μ in thickness to form a bond layer of 0.8 g/m$^2$ after drying.

A dispersion of 5 g of pigment No. 12 in Synthetic Process Example 2, 10 g of the above-mentioned polyester resin solution (in Examples 2–11), and 80 ml of tetrahydrofuran was coated on said bond layer to form a charge generation layer of 0.2 g/m$^2$ after drying.

Then, a solution prepared by dissolving 5 g of 4-N,N-diethylaminobenzaldehyde-N,N-diphenylhydrazone and 5 g of poly (methyl methacrylate) resin (number average M.W. about $1\times10^5$) in 70 ml of tetrahydrofuran was coated on the charge generation layer to form a charge transport layer of 10 g/m$^2$ after drying.

Charge bearing characteristics of the photosensitive member thus prepared were measured according to the prescribed method.

The results were as follows:

Vo: ⊖520 V; Vk: 91%; $E_{\frac{1}{2}}$: 7.8 lux·sec.

EXAMPLES 14–27

A dispersion of 5 g of each azo pigment represented by the foregoing formula (1)', wherein $A_1$, $R_1$, and $R_2$ are shown in Table 5, 2 g of poly (vinyl butyral) resin (degree of butyral conversion 65 mol %), and 95 ml of ethanol was prepared using a ball mill and coated on the same bond layer formed on the same aluminum plate as used in Example 13 to form a charge generation layer of 0.2 g/m² after drying.

Then, the same solution for forming a charge transport layer as used in Example 13 was coated on the charge generation layer by using a Baker applicator to give a dry film thickness of 10 g/m².

Charge bearing characteristics of the photosensitive members thus obtained were measured according to the prescribed method.

Structures of the pigments used and the measured charge bearing characteristics are shown in Tables 5 and 6, respectively.

TABLE 5

| Example No. | Pigment No. | Structure of pigment used: Pigment represented by formula (1)' $A_1$ | $R_1$ | $R_2$ |
|---|---|---|---|---|
| 14 | 13 | 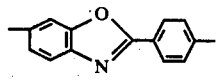 | $-CH_3$ | 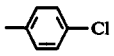 |
| 15 | 14 | 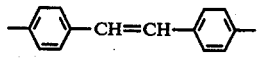 | $-C_2H_5$ | 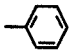 |
| 16 | 15 | 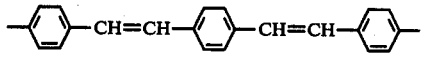 | $-CH_3$ | 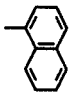 |
| 17 | 16 | 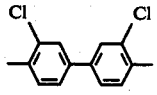 | $-CH_3$ | 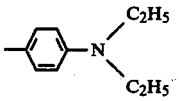 |
| 18 | 17 | 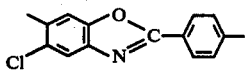 | $-CH_3$ | 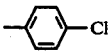 |
| 19 | 18 | 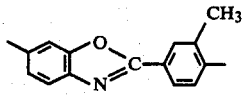 | $-CH_3$ | 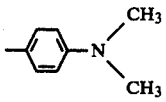 |
| 20 | 19 | 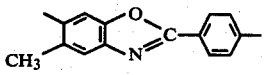 | $-CH_3$ | 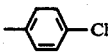 |
| 21 | 20 | 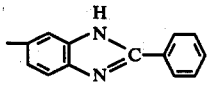 | $-CH_3$ | 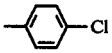 |
| 22 | 21 | 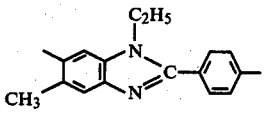 | $-CH_3$ | 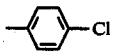 |
| 23 | 22 | 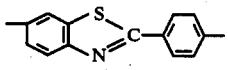 | $-CH_3$ | 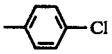 |
| 24 | 23 | 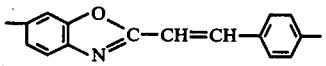 | $-CH_3$ | 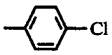 |
| 25 | 24 | 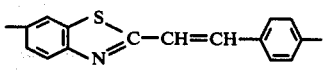 | $-CH_3$ | 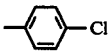 |

TABLE 5-continued

| Example No. | Pigment No. | Structure of pigment used: Pigment represented by formula (1)' $A_1$ | $R_1$ | $R_2$ |
|---|---|---|---|---|
| 26 | 25 | 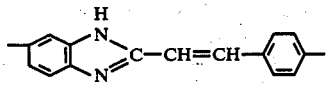 | $-CH_3$ | 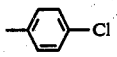 |
| 27 | 26 | 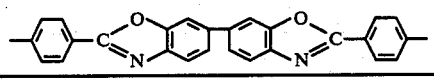 | $-CH_3$ | 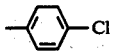 |

TABLE 6

| Example No. | Charge bearing characteristics: Vo (−V) | Vk (%) | E ½ (lux · sec) |
|---|---|---|---|
| 14 | 520 | 93 | 7.8 |
| 15 | 510 | 90 | 7.5 |
| 16 | 515 | 91 | 7.1 |
| 17 | 510 | 89 | 11.0 |
| 18 | 550 | 91 | 5.1 |
| 19 | 530 | 92 | 8.3 |
| 20 | 520 | 92 | 6.0 |
| 21 | 530 | 92 | 8.3 |
| 22 | 610 | 93 | 6.4 |
| 23 | 570 | 91 | 6.6 |
| 24 | 580 | 92 | 6.8 |
| 25 | 560 | 91 | 14.9 |
| 26 | 600 | 91 | 6.8 |
| 27 | 570 | 94 | 11.2 |

EXAMPLES 28-30

Five g of each azo pigment represented by the foregoing formula (2)', wherein $A_2$, $R_1$, and $R_2$ are shown in Table 7, was dispersed in a solution of 2 g of the above-mentioned poly (vinyl butyral) resin in 95 ml of ethanol using a ball mill and the resulting dispersion was coated on the same bond layer of the same aluminum plate as used in Example 13, by means of a Meyer bar to form a charge generation layer of 0.2 g/m$^2$ after drying.

Then, the same solution for forming a charge transport layer as used in Example 13 was coated on the charge generation layer by using a Baker applicator to give a dry film thickness of 10 g/m$^2$.

Charge bearing characteristics of the photosensitive members prepared in this way were measured according to the prescribed method.

Structures of the pigments used and the determined charge bearing characteristics are shown in Tables 7 and 8, respectively.

TABLE 7

| Example No. | Pigment No. | Structure of pigment used: Pigment represented by formula (2)' $A_2$ | $R_1$ | $R_2$ |
|---|---|---|---|---|
| 28 | 27 | 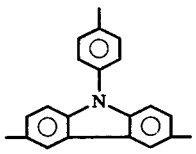 | $-CH_3$ | 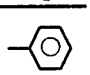 |

TABLE 7-continued

| Example No. | Pigment No. | Structure of pigment used: Pigment represented by formula (2)' $A_2$ | $R_1$ | $R_2$ |
|---|---|---|---|---|
| 29 | 28 | 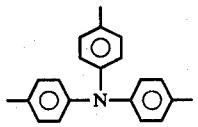 | $-CH_3$ | 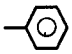 |
| 30 | 29 | 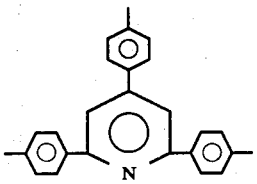 | $-CH_3$ | 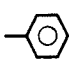 |

TABLE 8

| Example No. | Charge bearing characteristics: Vo (−V) | Vk (%) | E ½ (lux.sec) |
|---|---|---|---|
| 28 | 510 | 91 | 9.5 |
| 29 | 500 | 89 | 10.4 |
| 30 | 515 | 92 | 8.6 |

EXAMPLE 31

A solution prepared by dissolving 5 g of 2,4,7-trinitrofluorenone and 6 g of the polycarbonate mentioned before (Example 1) in 10 ml of tetrahydrofuran was coated on the charge generation layer prepared in Example 13, to form a charge transport layer of 12 g/m$^2$ after drying. Charge bearing characteristics of the photosensitive member obtained was measured according to the prescribed method, except for charging the member positively. The results were as follows:

Vo: ⊕520 V; Vk: 88%; E½: 18.7 lux·sec.

EXAMPLE 32

A solution of casein in aqueous ammonia was coated on an aluminum plate of 100μ in thickness and dried to form a bond layer of 1.0 g/m$^2$.

Then, 1.0 g of pigment No. 13, the same one as used in Example 14, was added to a solution prepared by dissolving 5 g of 2-(4-N,N-diethylaminophenyl)-4-(4-N,N-dimethylaminophenyl)-5-(2-chlorophenyl) oxazole and 5 g of the poly N-vinylcarbazole) mentioned before (in Example 12) in 70 ml of tetrahydrofuran, and it was dispersed and coated on the bond layer to form a photosensitive layer of 12 g/m$^2$ after dying.

Charge bearing characteristics of the photosensitive member thus prepared were measured according to the prescribed method, except for charging it positively. The results were as follows:

Vo: +500 V; Vk: 90%; $E_{\frac{1}{2}}$: 20.4 lux·sec.

EXAMPLE 33

After 5 g of 1-phenyl-3-(4-N,N-diethylaminostyryl)-5-(4-N,N-diethylaminophenyl) pyrazoline and 5 g of isophthalic acid-terephthalic acid copolyester of bisphenol A (molar ratio of isophthalic acid to terephthalic acid = 1:1) were dissolved in 70 ml of tetrahydrofuran, 1.0 g of pigment No. 12, the same one as used in Example 13, was added thereto and dispersed. The dispersion was coated on the same bond layer of the same plate as used in Example 13, and dried to form a photosensitive layer of 12 g/m$^2$.

Charge bearing characteristics of the photosensitive member thus prepared were measured according to the prescribed method, except for charging it positively. The results were as follows:

Vo: ⊕525 V; Vk: 91%; $E_{\frac{1}{2}}$: 17.8 lux·sec.

EXAMPLE 34

An aqueous solution of poly (vinyl alcohol) was coated on an aluminum plate of 100μ in thickness and dried to form a bond layer of 0.8 g/m$^2$.

Then, 5 g of pigment No. 30 cited above and 10 g of the same polyester resin solution as used in Examples 2–11 and 13 (Polyester Adhesive 49,000, made by Du Pont Co., 20% solids) were dispersed in 80 ml of tetrahydrofuran. The dispersion was coated on said bond layer to form a charge generation layer of 0.20 g/m$^2$ after drying.

Then 5 g of 4-N,N-diethylaminobenzaldehyde-N,N-diphenylhydrazone and 5 g of the poly (methyl methacrylate) resin mentioned before (in Example 13) were dissolved in 70 ml of tetrahydrofuran, and the solution was coated on the charge generation layer to form a charge transport layer of 10 g/m$^2$ after drying.

Charge bearing characteristics of the photosensitive member thus prepared were measured according to the prescribed method.

Vo: ⊖510 V; Vk: 89%; $E_{\frac{1}{2}}$: 7.2 lux·sec.

EXAMPLE 35–49

After 5 g of each azo pigment represented by formula (1)', wherein $A_1$, $R_1$, and $R_2$ are shown in Table 9, was dispersed in a solution of 2 g of the poly (vinyl butyral) resin mentioned before (in Example 1) in 95 ml of ethanol by using a ball mill, the resulting dispersion was coated by using a Meyer bar on the same bond layer of the same plate as used in Example 34, to form a charge generation layer of 0.2 g/m$^2$ after drying.

The same solution for forming a charge transport layer as used in Example 34 was coated on the charge generation layer by using a Baker applicator to give a dry film thickness of 10 g/m$^2$. Charge bearing characteristics of the photosensitive members prepared in this way were measured according to the prescribed method.

Structures of the pigments used and charge bearing characteristics of these photosensitive members are shown in Tables 9 and 10, respectively.

TABLE 9

| Example No. | Pigment No. | Structure of pigment used: Azo pigment represented by formula (1)' $A_1$ | $R_1$ | $R_2$ |
|---|---|---|---|---|
| 35 | 31 | 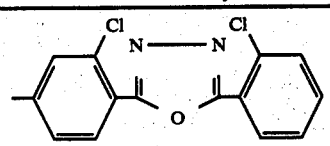 | —H | 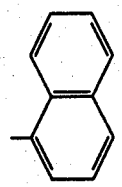 |
| 36 | 32 | 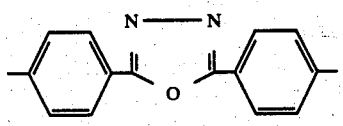 | —H | 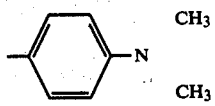 |
| 37 | 33 | 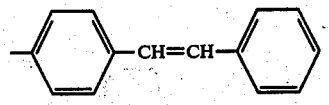 | —H | 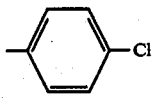 |
| 38 | 34 | 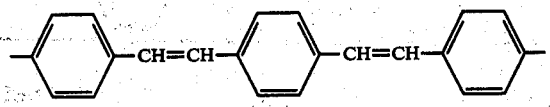 | —H | 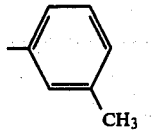 |
| 39 | 35 | 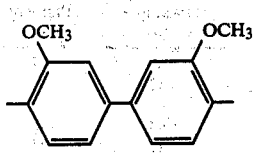 | —H | 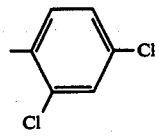 |

TABLE 9-continued
| Example No. | Pigment No. | Structure of pigment used: Azo pigment represented by formula (1)' $A_1$ | $R_1$ | $R_2$ |
|---|---|---|---|---|
| 40 | 36 | 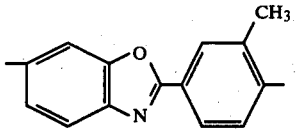 | —H | 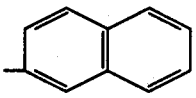 |
| 41 | 37 | 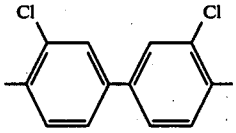 | —H | 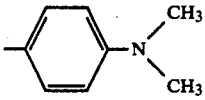 |
| 42 | 38 | 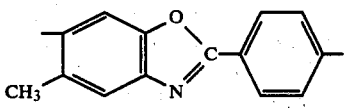 | —H | 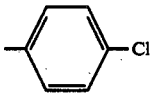 |
| 43 | 39 | 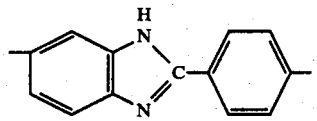 | —H | 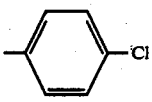 |
| 44 | 40 | 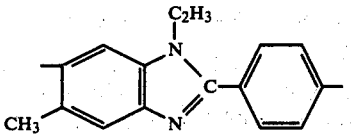 | —H | 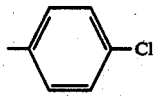 |
| 45 | 41 | 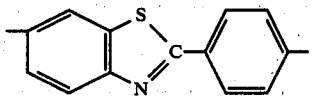 | —H | 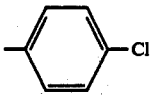 |
| 46 | 42 | 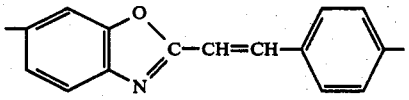 | —H | 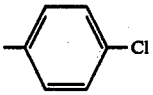 |
| 47 | 43 | 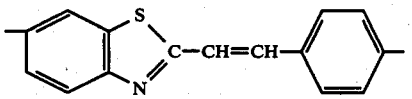 | —H | 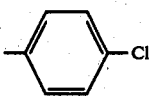 |
| 48 | 44 | 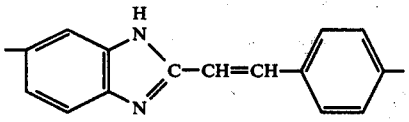 | —H | 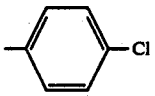 |
| 49 | 45 | 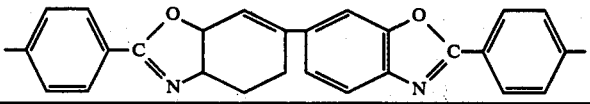 | —H | 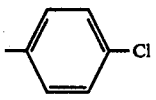 |
TABLE 10
| Example No. | Charge bearing characteristics: Pigment No. | Vo (⊖V) | Vk (%) | E ½ (lux.sec) |
|---|---|---|---|---|
| 35 | 31 | 580 | 94 | 14.2 |
| 36 | 32 | 545 | 93 | 8.5 |
| 37 | 33 | 505 | 84 | 7.2 |
| 38 | 34 | 520 | 89 | 8.5 |
| 39 | 35 | 500 | 86 | 7.4 |
| 40 | 36 | 520 | 90 | 6.8 |
TABLE 10-continued
| Example No. | Charge bearing characteristics: Pigment No. | Vo (⊖V) | Vk (%) | E ½ (lux.sec) |
|---|---|---|---|---|
| 41 | 37 | 525 | 90 | 9.2 |
| 42 | 38 | 520 | 93 | 6.2 |
| 43 | 39 | 520 | 91 | 8.5 |
| 44 | 40 | 610 | 93 | 5.3 |
| 45 | 41 | 600 | 93 | 6.6 |
| 46 | 42 | 600 | 92 | 6.0 |

TABLE 10-continued

| Example No. | Charge bearing characteristics Pigment No. | Vo (⊖V) | Vk (%) | E ½ (lux.sec) |
|---|---|---|---|---|
| 47 | 43 | 550 | 90 | 15.3 |
| 48 | 44 | 600 | 92 | 7.2 |
| 49 | 45 | 580 | 94 | 10.3 |

EXAMPLES 50–52

Photosensitive members were prepared in the same way as Examples 35–49, except that azo pigments represented by formula (2)', wherein $A_2$, $R_1$, and $R_2$ are shown in Table 11 were used. Charge bearing characteristics of the phostosensitive members thus prepared were measured also according to the prescribed method.

Structures of the pigments used and charge bearing characteristics of these photosensitive members are shown in Tables 11 and 12, respectively.

TABLE 11

| Example No. | Pigment No. | Structure of pigment used: Pigment represented by formula (2)' $A_2$ | $R_1$ | $R_2$ |
|---|---|---|---|---|
| 50 | 46 | 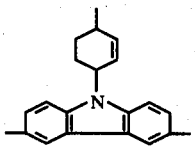 | —H | 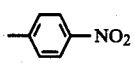 |
| 51 | 47 | 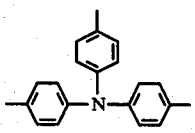 | —H | 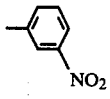 |
| 52 | 48 | 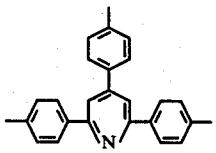 | —H | 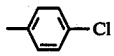 |

TABLE 12

| Example No. | Charge bearing characteristics Vo (−V) | Vk (%) | E ½ (lux.sec) |
|---|---|---|---|
| 50 | 530 | 88 | 10.5 |
| 51 | 525 | 90 | 11.0 |
| 52 | 530 | 88 | 7.2 |

EXAMPLE 53

A solution prepared by disolving 5 g of 2,4,7-trinitrofluorenone and 5 g of the polycarbonate mentioned before (M.W. about $3\times10^4$) in 70 ml of tetrahydrofuran was coated on the charge generation layer prepared in Example 34 to form a charge transport layer of 18 g/m² after drying. Charge bearing characteristics of the photosensitive member were measured according to the prescribed method, except for charging the member positively.

Vo: ⊕ 530 V; Vk: 86%; E ½: 19.6 lux·sec.

EXAMPLE 54

A solution of casein in aqueous ammonia was coated on an aluminum plate of 100μ in thickness and dried to form a bond layer of 1.0 g/m².

Then, a dispersion of 1.0 g of pigment No.36, the same one as used in Example 40, in a solution prepared by dissolving 5 g of 2-(4-N,N-diethylaminophenyl)-4-(4-N,N-dimethylaminophenyl)-5-(2-chlorophenyl) oxazole and 5 g of the poly (N-vinyl carbazole) mentioned before (in Example 12) in 70 ml of tetrahydrofuran was coated on said bond layer and dried to form a photosensitive layer of 12 g/m².

Charge bearing characteristics of the photosensitive member thus prepared were measured according to the prescribed method, except for charging the member positively.

The results were as follows:

Vo: ⊕ 505 V; Vk: 89%; E ½: 21.5 lux·sec.

EXAMPLE 55

To a solution prepared by dissolving 5 g of 1-phenyl-3-(4-N,N-diethylaminostyryl)-5-(4-N,N-diethylaminophenyl) pyrazoline and 5 g of isophthalic acid-terephthalic acid copolyester of bisphenol A (molar ratio of isophthalic acid to terephthalic acid = 1:1) in 70 ml of tetrahydrofuran, was added and dispersed 1.0 g of pigment No.30, the same one as used in Example 34. The resulting dispersion was coated on the same bond layer of the same plate as used in Example 34, and dried to form a photosensitive layer of 12g/m².

Charge bearing characteristics of the photosensitive member thus prepared were measured according to the prescribed method, except for charging it positively.

Vo: ⊕ 535 V; Vk: 91%; E ½: 16.5 lux·sec.

EXAMPLE 56

A dispersion formed from 5 g of the following disazo pigment, 10 g of the foregoing polyester resin solution, and 80 ml of tetrahydrofuran was coated on the surface of aluminum vacuum deposited on a Mylar film, and dried to form a charge generation layer of 0.2 g/m².

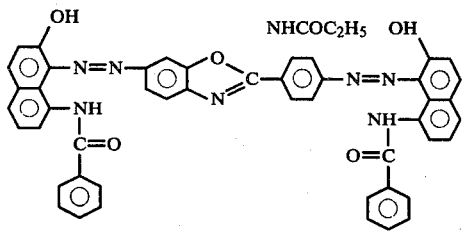

(No. 49)

Then, a solution prepared by dissolving 5 g of 1-phenyl-3-(4-N,N-diethylaminostyryl)-5-(4-N,N-diethylaminophenyl) pyrazoline and 5 g of the foregoing polycarbonate (M.W. about $3\times10^4$) in 70 ml of tetrahydrofuran was coated on the charge generation layer and dried to form a charge transport layer of 10 g/m².

Charge bearing characteristics of the photosensitive member thus prepared were measured according to the prescribed method.

Vo: ⊖ 580 V; Vk: 81%; E ½: 11.4 lux·sec.

EXAMPLE 57

A dispersion formed from 5 g of the following disazo pigment, 10 g of the foregoing polyester resin solution, and 80 ml of tetrahydrofuran was coated on the surface of aluminum vacuum deposited on a Mylar film, and dried to form a charge generation layer of 0.15 g/m$^2$.

(No. 50)

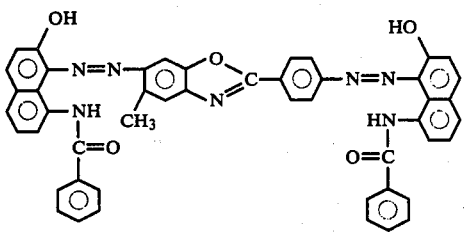

Then, a solution prepared by dissolving 5 g of 2,5-bis(4-N,N-diethylaminophenyl)-1,3,4-oxadiazole and 5 g of the foregoing poly (methyl methacrylate) in 70 ml of tetrahydrofuran was coated on the charge generation layer and dried to form a charge transport layer of 11 g/m$^2$. Charge bearing characteristics of the photosensitive member thus prepared were measured according to the prescribed method.

Vo: ⊖ 570 V; Vk: 89%; E ½: 10.0 lux·sec.

EXAMPLE 58

A photosensitive member was prepared in the same manner as Example 57, except that the following disazo pigment was used to form the charge generation layer. Measurements of charge bearing characteristics were made also according to the prescribed method.

(No. 51)

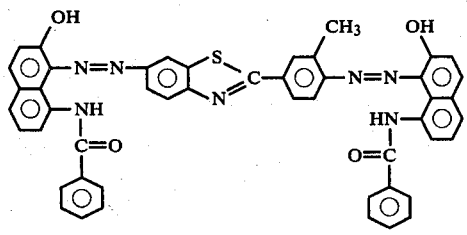

Vo: ⊖ 580 V; Vk: 91%; E ½: 10.2 lux·sec.

EXAMPLE 59

After 5 g of the following pigment was dispersed in a solution of 2 g of the foregoing poly (vinyl butyral) resin (degree of butyral conversion: 63 mol %) in 95 ml of ethanol, the resulting dispersion was coated on the surface of aluminum vacuum deposited on a Mylar film, to form a charge generation layer of 0.2 g/m$^2$ after drying.

(No. 52)

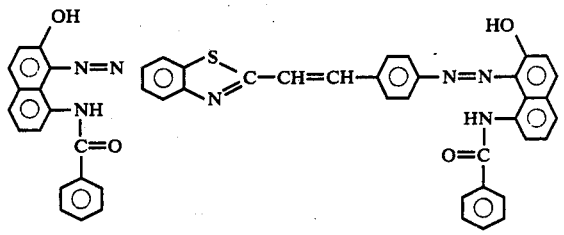

Then, a solution prepared by dissolving 5 g of 1-phenyl-3-(4-N,N-diethylaminostyryl)-5-(4-N,N-diethylaminophenyl) pyrazoline and 5 g of the foregoing poly carbonate (M.W. about $3\times10^4$) in 70 ml of tetrahydrofuran was coated on the charge generation layer to form a charge transport layer of 11 g/m$^2$ after drying.

Charge bearing characteristics of the photosensitive member prepared were measured according to the prescribed method.

Vo: ⊖ 550 V; Vk: 89%; E ½: 12.0 lux·sec.

EXAMPLE 60

An aqueous solution of hydroxypropylcellulose was coated on the surface of aluminum vacuum deposited on a Mylar film, and dried to form a bond layer of 0.8 g/m$^2$.

A dispersion of 5 g of the following disazo pigment in a solution of 2 g of the foregoing poly (vinyl butyral) resin (degree of butyral conversion: 63 mol %) in 95 ml of ethanol was coated on said bond layer and dried to form a charge generation layer of 0.2 g/m$^2$.

(No. 53)

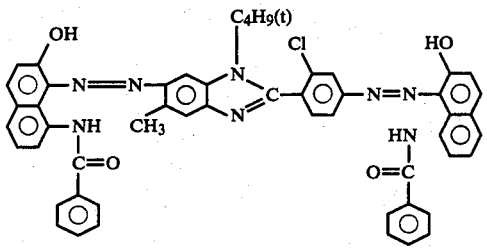

A solution prepared by dissolving 5 g of 1-phenyl-3-(4-N,N-diethylaminostyryl)-5-(4-N,N-diethylaminophenyl) pyrazoline and 5 g of the foregoing polycarbonate (M.W. about $3\times10^4$) in 70 ml of tetrahydrofuran was coated on said charge generation layer to form a charge transport layer of 11 g/m$^2$ after drying.

Charge bearing characteristics of the photosensitive member thus prepared were measured according to the prescribed method.

Vo: ⊖ 580 V; Vk: 89%; E ½: 8.8 lux·sec.

EXAMPLE 61

After 5 g of the following disazo pigment was dispersed in a solution of 2 g of the aforementioned poly (vinyl butyral) resin in 95 ml of ethanol, the resulting dispersion was coated on the surface of aluminum vacuum deposited on a Mylar film, to form a charge generation layer of 0.2 g/m$^2$ after drying.

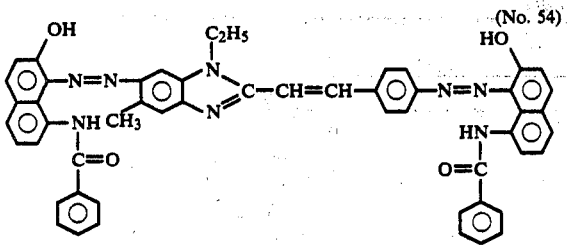

A solution prepared by dissolving 5 g of 1-phenyl-3-(4-N,N-diethylaminostyryl)-5-(4-N,N-diethylaminophenyl) pyrazoline and 5 g of the isophthalic acid-terephthalic acid copolyester of bisphenol A mentioned before in 70 ml of tetrahydrofuran was coated on said charge generation layer to form a charge transport layer of 11 g/m$^2$ after drying.

Charge bearing characteristics of the photosensitive member were measured according to the prescribed method.

Vo: ⊖ 560 V; Vk: 86%; E ½: 10.0 lux·sec.

EXAMPLE 62–72

An aqueous solution of poly (vinyl alcohol) was coated on aluminum plates of 100μ in thickness and dried to form bond layers of 0.8 g/m$^2$.

After 5 g of each azo pigment represented by formula (1)", wherein $A_1$, $R_1$, and $R_2$ are shown in Table 13, was dispersed in a solution of 2 g of the above-mentioned poly (vinyl butyral) resin in 95 ml of ethanol, the resulting dispersion was coated on said bond layer to form a charge generation layer of 0.2 g/m$^2$ after drying.

A solution prepared by dissolving 5 g of 4-N,N-diethylaminobenzaldehyde-N,N-diphenylhydrazone and 5 g of the aforementioned poly (methyl methacrylate) (number average M.W.: about $1\times10^5$) in 70 ml of tetrahydrofuran was coated on said charge generation layer to form a charge transport layer of 10 g/m$^2$ after drying.

Charge bearing characteristics of the photosensitive members in this way were measured according to the prescribed method.

Structures of pigments used and charge bearing characteristics of these photosensitive members are shown in Tables 13 and 14, respectively.

TABLE 13

| Example No. | Pigment No. | Structure of pigment used: Azo pigment represented by formula (1)" $A_1$ | $R_1$ | $R_2$ |
|---|---|---|---|---|
| 62 | 55 | 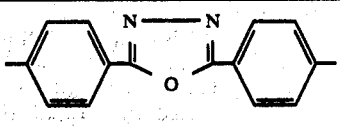 | —H | 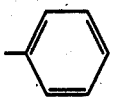 |
| 63 | 56 | 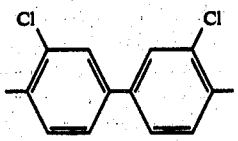 | —H | 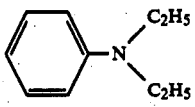 |
| 64 | 57 | 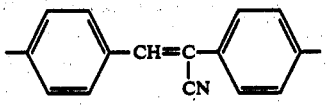 | —H | 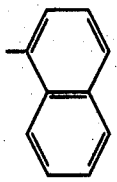 |
| 65 | 58 | 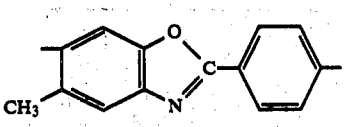 | —H | 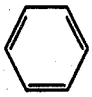 |
| 66 | 59 | 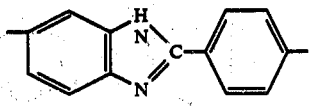 | —H | 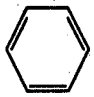 |
| 67 | 60 | 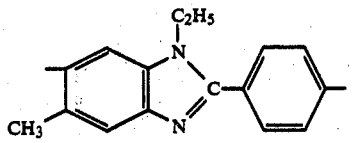 | —H | 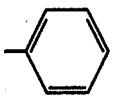 |
| 68 | 61 | 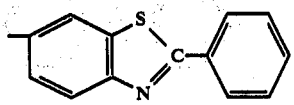 | —H | 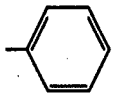 |

TABLE 13-continued

| Example No. | Pigment No. | Structure of pigment used: Azo pigment represented by formula (1)" $A_1$ | $R_1$ | $R_2$ |
|---|---|---|---|---|
| 69 | 62 | 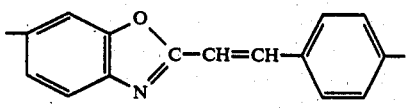 | —H | 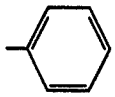 |
| 70 | 63 | 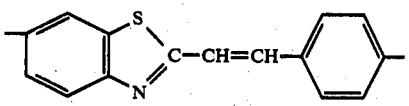 | —H | 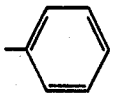 |
| 71 | 64 | 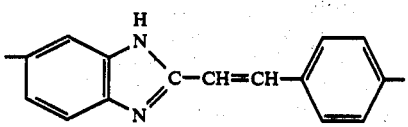 | —H | 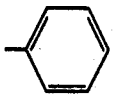 |
| 72 | 65 | 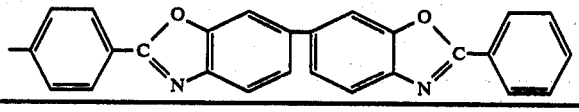 | —H | 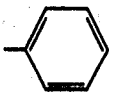 |

TABLE 14

| Example No. | Charge bearing characteristics: Vo (−V) | Vk (%) | E ½ (lux · sec) |
|---|---|---|---|
| 62 | 510 | 90 | 8.5 |
| 63 | 500 | 86 | 9.7 |
| 64 | 520 | 92 | 7.4 |
| 65 | 520 | 91 | 6.5 |
| 66 | 515 | 92 | 9.8 |
| 67 | 600 | 90 | 6.7 |
| 68 | 570 | 90 | 7.8 |
| 69 | 560 | 90 | 8.8 |
| 70 | 550 | 91 | 12.7 |
| 71 | 600 | 93 | 6.4 |
| 72 | 600 | 91 | 9.2 |

EXAMPLES 73-75

Electrophotographic photosensitive members were prepared in the same manner as Examples 62-72, except that the azo pigments used were changed to those represented by formula (2)", wherein $A_2$, $R_1$, and $R_2$ are shown in Table 15.

Charge bearing characteristics of the photosensitive members thus prepared were measured also according to the same prescribed method.

Structures of the pigments used and charge bearing characteristics of the photosensitive members are shown in Tables 15 and 16, respectively.

TABLE 15

| Example No. | Pigment No. | Structure of pigment used: Azo pigment represented by formula (2)" $A_2$ | $R_1$ | $R_2$ |
|---|---|---|---|---|
| 73 | 66 | 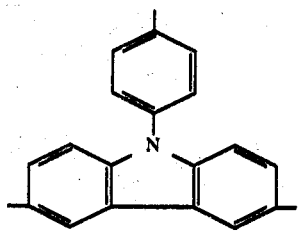 | —H | 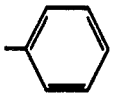 |
| 74 | 67 | 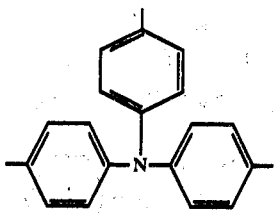 | —H | 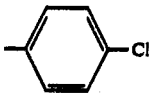 |

TABLE 15-continued

| Example No. | Pigment No. | Structure of pigment used: Azo pigment represented by formula (2)" $A_2$ | $R_1$ | $R_2$ |
|---|---|---|---|---|
| 75 | 68 | 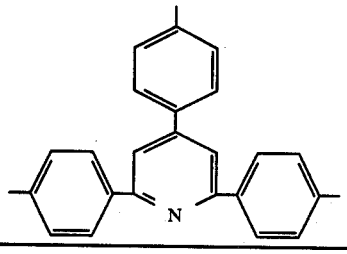 | $-C_2H_5$ | 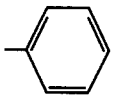 |

TABLE 16

| Example No | Charge bearing characteristics: Vo (−V) | Vk (%) | E ½ (lux sec) |
|---|---|---|---|
| 73 | 525 | 91 | 9.5 |
| 74 | 515 | 90 | 10.5 |
| 75 | 520 | 89 | 7.6 |

EXAMPLES 76–79

Electrophotographic photosensitive members were prepared in the same manner as Examples 62–72, except that the following pigments, Nos. 69, 70, 71 and 72, were used in place of the disazo pigments used in said Examples, and charge bearing characteristics thereof were measured according to the prescribed method. The results are shown in Table 17.

Pigment No.

(No. 69)

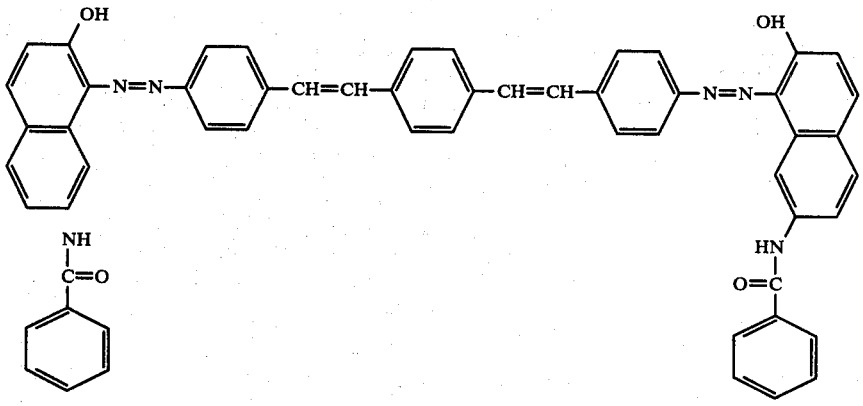

(No. 70)

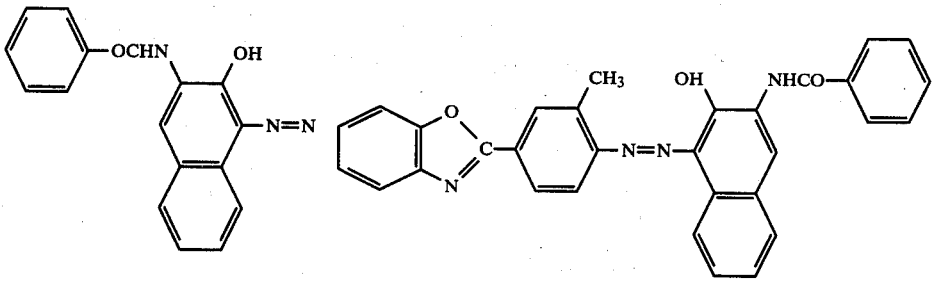

-continued

Pigment No.

(No. 71)

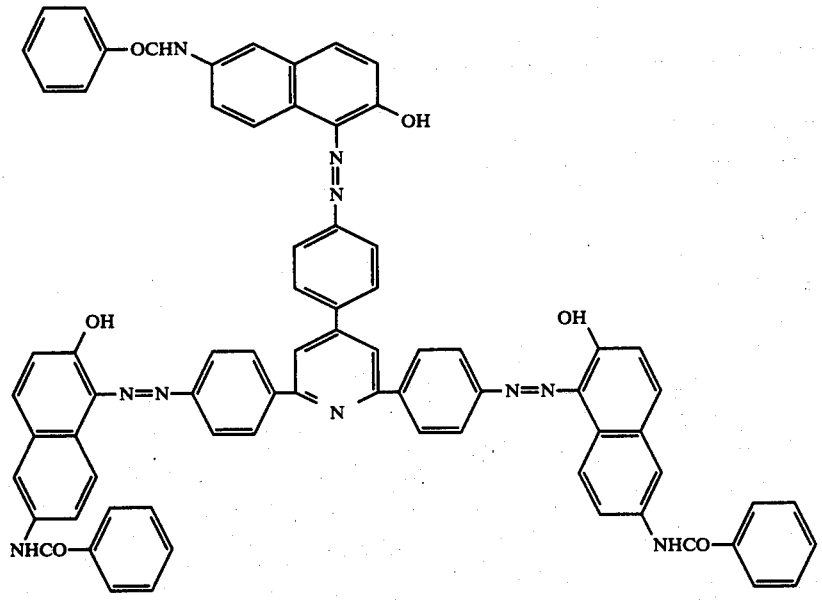

(No. 72)

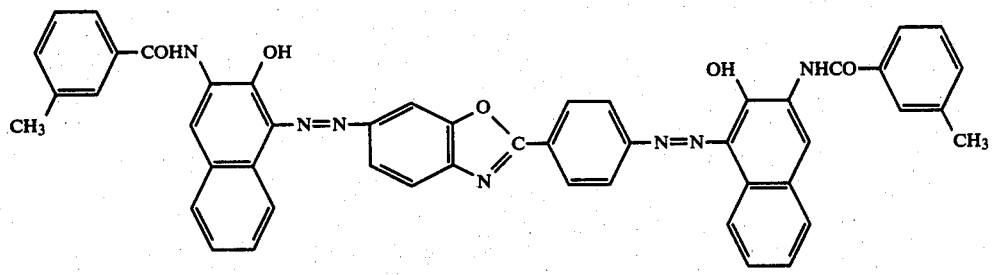

TABLE 17

| Example No. | Charge bearing characteristics Pigment No. | Vo (−V) | Vk (%) | E ½ (lux · sec) |
|---|---|---|---|---|
| 76 | 69 | 530 | 91 | 8.6 |
| 77 | 70 | 540 | 92 | 7.2 |
| 78 | 71 | 530 | 91 | 8.8 |
| 79 | 72 | 515 | 91 | 7.2 |

EXAMPLES 80–91

Electrophotographic photosensitive members were prepared in the same manner as Examples 62–79, except that the azo pigments used were changed to those of formula (3)', wherein $A_1$, $R_1$, and $R_2$ are shown in Table 18.

Measurement of charge bearing characteristics thereof were also in accordance with the same prescribed method.

Structures of the pigments used and charge bearing characteristics are shown in Tables 18 and 19, respectively.

TABLE 18

| Example No. | Pigment No. | Structure of pigment used: Azo pigment represented by formula (3)' $A_1$ | $R_3$ | $R_4$ |
|---|---|---|---|---|
| 80 | 73 | 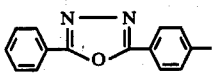 | −H | 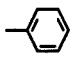 |
| 81 | 74 | 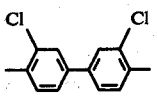 | −H | 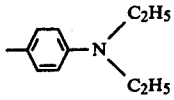 |

TABLE 18-continued

| Example No. | Pigment No. | Structure of pigment used: Azo pigment represented by formula (3)' $A_1$ | $R_3$ | $R_4$ |
|---|---|---|---|---|
| 82 | 75 | 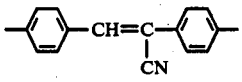 | —H | 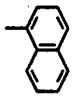 |
| 83 | 76 | 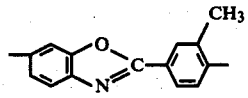 | —H | 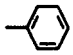 |
| 84 | 77 | 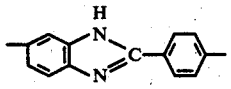 | —H | 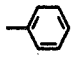 |
| 85 | 78 | 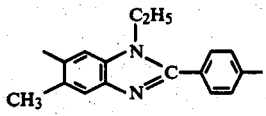 | —H | 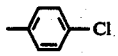 |
| 86 | 79 | 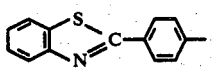 | 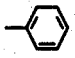 | 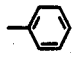 |
| 87 | 80 | 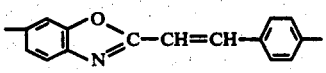 | —H | 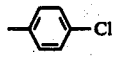 |
| 88 | 81 | 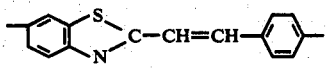 | —H | 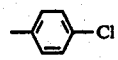 |
| 89 | 82 | 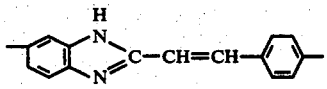 | —H | 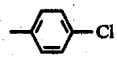 |
| 90 | 83 | 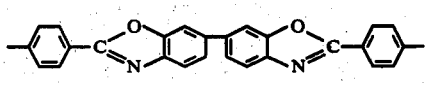 | —H | 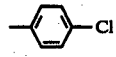 |
| 91 | 84 | 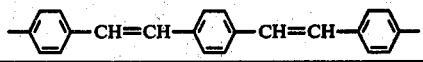 | —H | 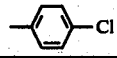 |

TABLE 19

| Example No. | Charge bearing characteristics: Vo (−V) | Vk (%) | E ½ (lux.sec) |
|---|---|---|---|
| 80 | 520 | 89 | 9.0 |
| 81 | 520 | 87 | 10.2 |
| 82 | 510 | 91 | 7.2 |
| 83 | 510 | 91 | 7.0 |
| 84 | 500 | 92 | 10.8 |
| 85 | 550 | 90 | 8.5 |
| 86 | 570 | 91 | 6.4 |
| 87 | 520 | 91 | 8.9 |
| 88 | 510 | 93 | 14.4 |
| 89 | 530 | 94 | 6.7 |
| 90 | 550 | 92 | 10.9 |
| 91 | 515 | 92 | 8.9 |

EXAMPLES 92–94

Electrophotographic photosensitive members were prepared in the same manner as Examples 62–91, except that the azo pigments used were changed to those represented by formula (4)', wherein $A_2$, $R_3$, and $R_4$ are shown in Table 20.

Measurements of charge bearing characteristics thereof were also in accordance with the same prescribed method.

Structures of the pigments used and charge bearing characteristics are shown in Tables 20 and 21, respectively.

TABLE 20

| Example No. | Pigment No. | Structure of pigment used: Azo pigment represented by formula (4)' $A_2$ | $R_3$ | $R_4$ |
|---|---|---|---|---|
| 92 | 85 | 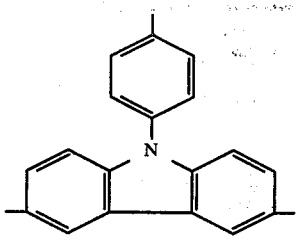 | —H | 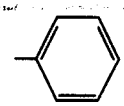 |
| 93 | 86 | 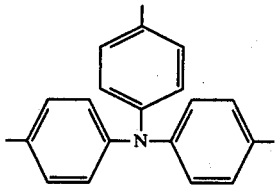 | —H | 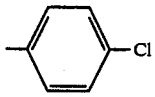 |
| 94 | 87 | 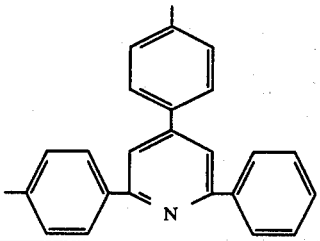 | $—C_2H_5$ | 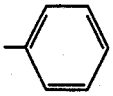 |

TABLE 21

| Example No. | Charge bearing characteristics: Vo (−V) | Vk (%) | E ½ (lux.sec) |
|---|---|---|---|
| 92 | 515 | 92 | 10.3 |
| 93 | 520 | 90 | 10.7 |
| 94 | 515 | 88 | 8.2 |

EXAMPLE 95

A solution of casein in aqueous ammonia was coated on an aluminum plate of 100μ in thickness and dried to form a bond layer of 1.0 g/m$^2$.

To a solution prepared by dissolving 5 g of 2-(4-N,N-diethylaminophenyl)-4-(4-N,N-dimethylaminiphenyl)-5-(2-chlorophenyl) oxazole and 5 g of the poly (N-vinylcarbazole) mentioned before in 70 ml tetrahydrofuran, was added and dispersed 1.0 g of pigment No. 68, the same one as used in Example 75. The dispersion was coated on said bond layer and dried to form a coat of 12 g/m$^2$.

Charge bearing characteristics of the photosensitive member thus prepared were measured according to the prescribed method, except for charging the member positively.

Vo:510 V; Vk:88%; E ½:20.4 lux.sec.

What we claim is:

1. An electrophotographic photosensitive member comprising a conductive support, a charge transport layer, and a charge generating layer comprising azo pigments having at least one azo group linked to a coupler residue represented by the following formula or:

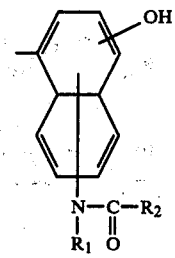

Formula [1]

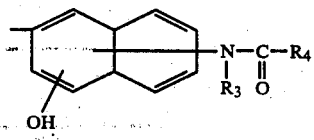

Formula [2]

2. An electrophotographic photosensitive member according to claim 1, wherein said electrophotographic photosensitive member is composed of multilaminate structure comprising a conductive support, a bond layer, a charge generation layer, and a charge transport layer, the layers being laminated in the above-mentioned order.

3. An electrophotographic photosensitive member according to claim 1, wherein said azo pigments are disazo pigments represented by the formula

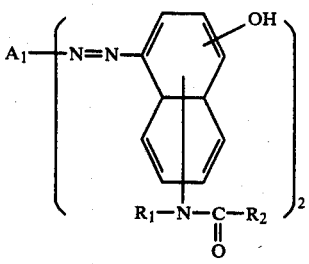

(1)

wherein $R_1$ is hydrogen, substituted or unsubstituted alkyl, substituted or unsubstituted aralkyl, or substituted or unsubstituted aryl; $R_2$ is substituted or unsubstituted aryl; and $A_1$ is a divalent organic residue.

4. An electrophotographic photosensitive member according to claim 3, wherein said azo pigments are disazo pigments represented by the following formula (1)' or (1)":

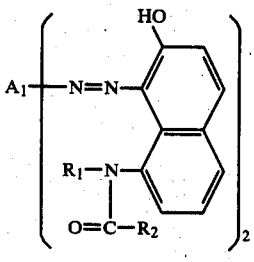

Formula (1)'

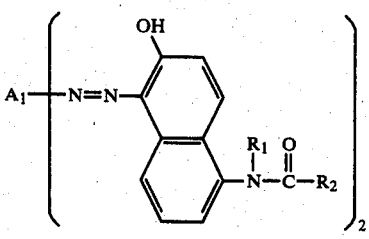

Formula (1)"

wherein $R_1$ is hydrogen, substituted or unsubstituted alkyl, substituted or unsubstituted aralkyl, or substituted or unsubstituted aryl; $R_2$ is substituted or unsubstituted aryl; and $A_1$ is a divalent organic residue.

5. An electrophotographic photosensitive member according to claim 4, wherein said $A_1$ is a divalent hydrocarbon radical having at least one benzene ring.

6. An electrophotographic photosensitive member according to claim 5, wherein said $A_1$ is a divalent organic residue selected from the group consisting of phenylene, naphthylene,

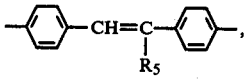

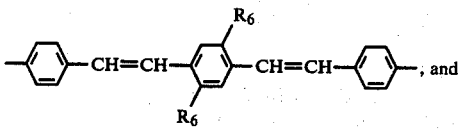

-continued

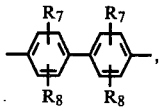

wherein $R_5$ is hydrogen or cyano, $R_6$ is hydrogen or alkoxy, and $R_7$ and $R_8$ independently of one another represent hydrogen, halogen, alkyl, alkoxy, or nitro.

7. An electrophotographic photosensitive member according to claim 6, wherein said $A_1$ is a divalent organic residue selected from the group consisting of

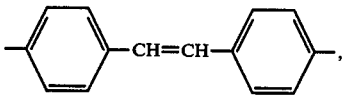

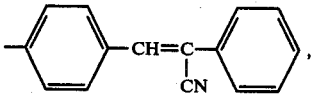

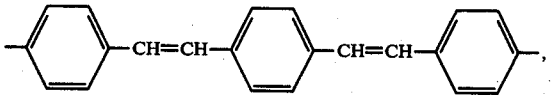

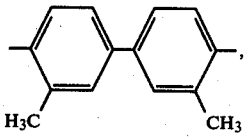

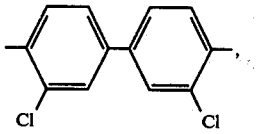

and

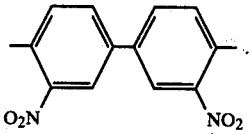

8. An electrographic photosensitive member according to claim 4, wherein said $A_1$ is a nitrogen-containing divalent hydrocarbon radical having at least two benzene rings.

9. An electrophotographic photosensitive member according to claim 8, wherein said $A_1$ is a nitrogen-containing divalent hydrocarbon radical selected from the group consisting of

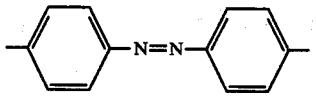

and

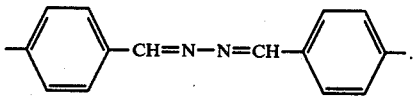

10. An electrophotographic photosensitive member according to claim 4, wherein said $A_1$ is a divalent hydrocarbon radical having at least two benzene rings and at least one hetero-ring.

11. An electrophotographic photosensitive member according to claim 10, wherein said $A_1$ is a divalent organic residue selected from the group consisting of

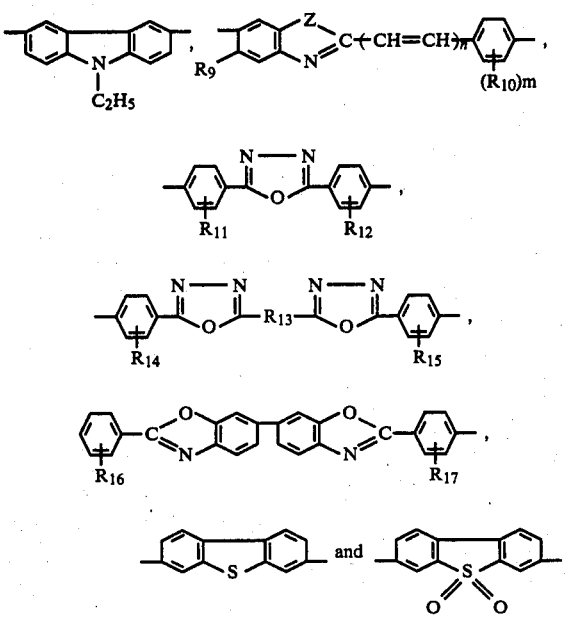

wherein, Z is oxygen, sulfur, or >N-$R_{18}$ ($R_{18}$: hydrogen or lower alkyl); $R_9$ is hydrogen, halogen, or lower alkyl; $R_{10}$ is hydrogen, halogen, lower alkyl, alkoxy, hydroxy, nitro, dialkylamino, or acylamino; n is 0 or 1; m is an integer of 1–4; $R_{11}$ and $R_{12}$ independently of one another represent hydrogen, lower alkyl, or halogen; $R_{13}$ is single bond, substituted or unsubstituted phenylene, or substituted or unsubstituted vinylene; $R_{14}$ and $R_{15}$ independently of one another represent hydrogen, halogen, lower alkyl; and $R_{16}$ and $R_{17}$ independently of one another represent hydrogen, halogen, lower alkyl, alkoxy, nitro, or acylamino.

12. An electrophotographic photosensitive member according to claim 11, wherein said $A_1$ is a divalent organic residue selected from the group consisting of

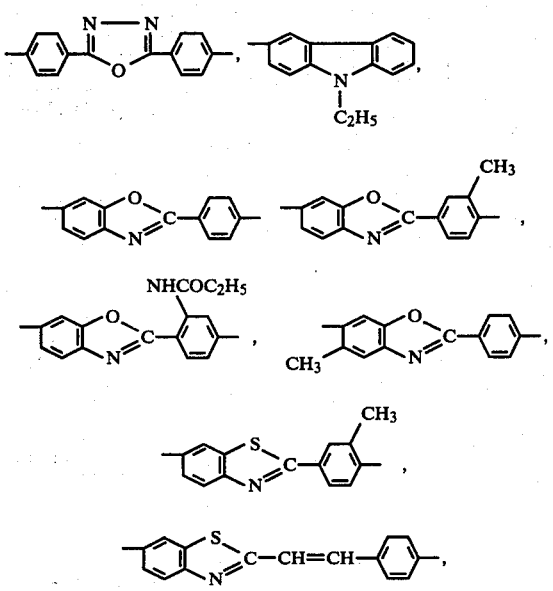

-continued

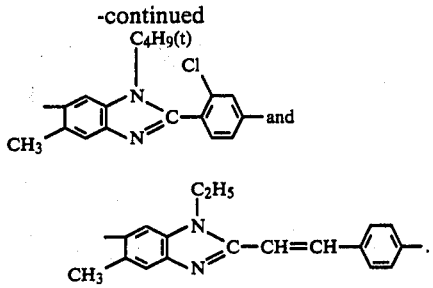

13. An electrophotographic photosensitive member according to claim 1, wherein said azo pigments are trisazo pigments represented by the formula

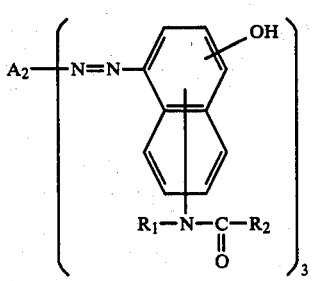

(2)

wherein $R_1$ is hydrogen, substituted or unsubstituted alkyl, substituted or unsubstituted aralkyl, or substituted or unsubstituted aryl; $R_2$ is substituted or unsubstituted aryl; and $A_2$ is a trivalent organic residue.

14. An electrophotographic photosensitive member according to claim 13, wherein said azo pigments are trisazo pigments represented by the formula

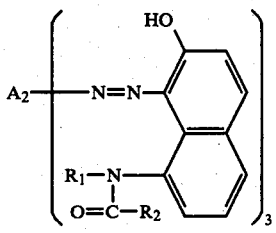

or (2)'

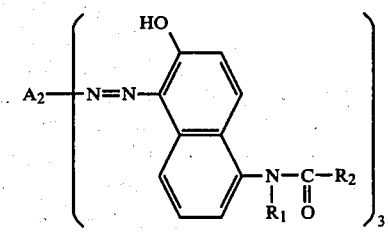

(2)'' wherein $R_1$ is hydrogen, substituted or unsubstituted alkyl, substituted or unsubstituted aralkyl, or substituted or unsubstituted aryl; $R_2$ is substituted or unsubstituted aryl; and $A_2$ is a trivalent organic residue.

15. An electrophotographic photosensitive member according to claim 14, wherein said $A_2$ is a nitrogen-containing trivalent hydrocarbon radical having at least two benzene rings.

16. An electrophotographic photosensitive member according to claim 15, wherein said $A_2$ is the following radical:

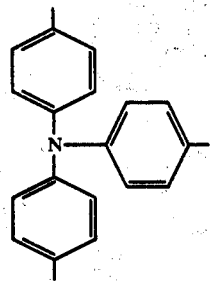

17. An electrophotographic photosensitive member according to claim 14, wherein said $A_2$ is a trivalent hydrocarbon radical having at least two benzene rings and at least one hetero-ring.

18. An electrophotographic photosensitive member according to claim 17, wherein said $A_2$ is a trivalent organic residue selected from the group consisting of

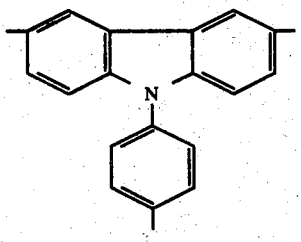

and

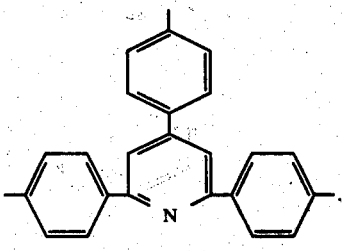

19. An electrophotographic photosensitive member according to claim 1, wherein said azo pigments are disazo pigments represented by the formula

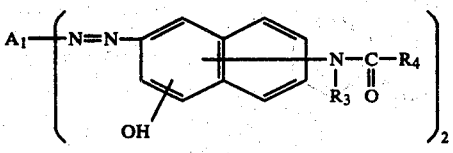

(3)

wherein, $R_3$ is hydrogen, substituted or unsubstituted alkyl, substituted or unsubstituted aralkyl, or substituted or unsubstituted aryl; $R_4$ is substituted or unsubstituted aryl; and $A_1$ is a divalent organic residue.

20. An electrophotographic photosensitive member according to claim 19, wherein said azo pigments are disazo pigments represented by the formula

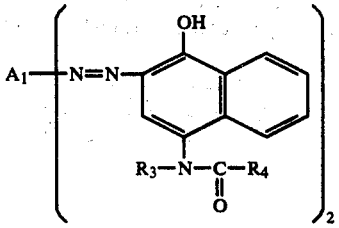

(3)' wherein $R_3$ is hydrogen, substituted or unsubstituted alkyl, substituted or unsubstituted aralkyl, or substituted or unsubstituted aryl; $R_4$ is substituted or unsubstituted aryl; and $A_1$ is a divalent organic residue.

21. An electrophotographic photosensitive member according to claim 20, wherein said $A_1$ is a divalent hydrocarbon radical having at least one benzene ring.

22. An electrophotographic photosensitive member according to claim 21, wherein said $A_1$ is a divalent organic residue selected from the group consisting of phenylene, naphthylene,

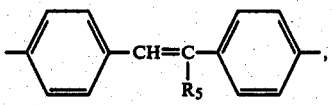

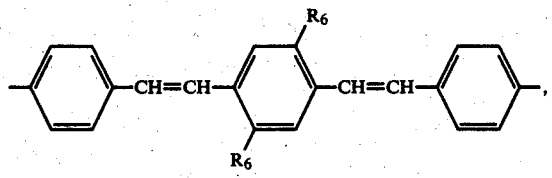

and

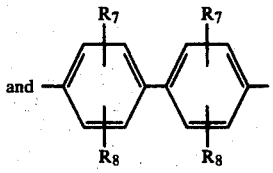

wherein $R_5$ is hydrogen or cyano, $R_6$ is hydrogen or alkoxy, $R_7$ and $R_8$ independently of one another represent hydrogen, halogen, alkyl, alkoxy, or nitro.

23. An electrophotographic photosensitive member according to claim 22, wherein said $A_1$ is a divalent organic residue selected from the group consisting of

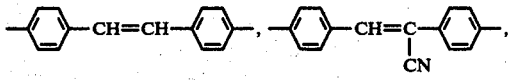

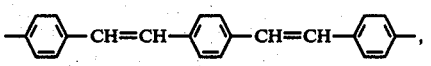

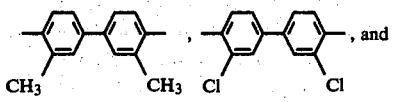

, and

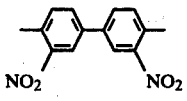

24. An electrophotographic photosensitive member according to claim 20, wherein said $A_1$ is a nitrogen-containing divalent hydrocarbon radical having at least two benzene rings.

25. An electrophotographic photosensitive member according to claim 24, wherein said $A_1$ is a nitrogen-containing divalent hydrocarbon radical selected from the group consisting of

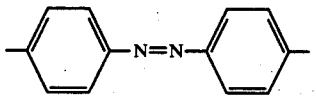

and

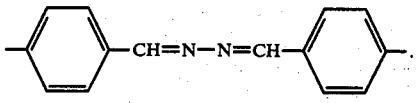

26. An electrophotographic photosensitive member according to claim 20, wherein said $A_1$ is a divalent hydrocarbon radical having at least two benzene rings and at least one hetero-ring.

27. An electrophotographic photosensitive member according to claim 26, wherein said $A_1$ is a divalent organic residue selected from the group consisting of

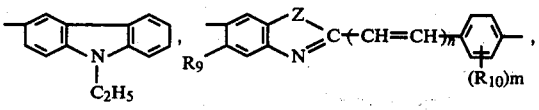

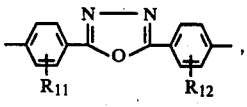

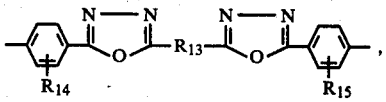

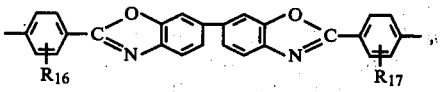

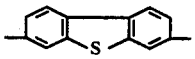

and

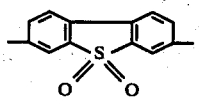

wherein Z is oxygen, sulfur, or N-$R_{18}$ ($R_{18}$: hydrogen or lower alkyl); $R_9$ is hydrogen, halogen, or lower alkyl; $R_{10}$ is hydrogen, halogen, lower alkyl, alkoxy, hydroxy, nitro, dialkylamino, or acylamino; n is 0 or 1; m is an integer of 1–4; $R_{11}$ and $R_{12}$ independently of one another represent hydrogen, lower alkyl, or halogen; $R_{13}$ is single bond, substituted or unsubstituted phenylene, or substituted or unsubstituted vinylene; $R_{14}$ and $R_{15}$ independently of one another represent hydrogen, halogen, or lower alkyl; and $R_{16}$ and $R_{17}$ independently of one another represent hydrogen, halogen, lower alkyl, alkoxy, nitro, or acylamino.

28. An electrophotographic photosensitive member according to claim 27, wherein said $A_1$ is a divalent organic residue selected from the group consisting of

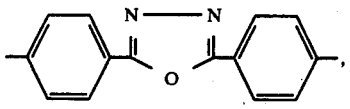

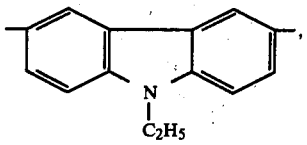

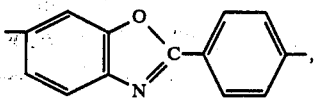

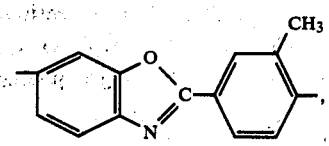

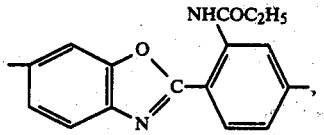

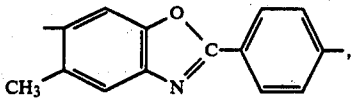

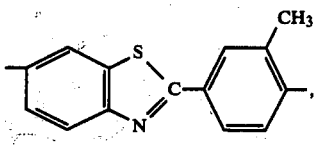

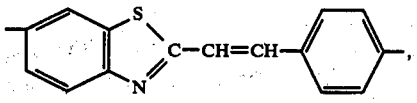

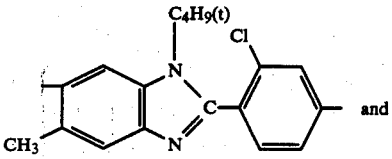

and

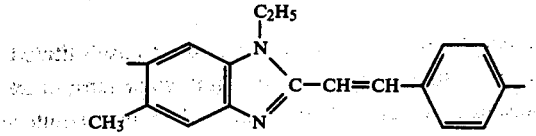

29. An electrophotographic photosensitive member according to claim 1, wherein said azo pigments are trisazo pigments represented by the formula

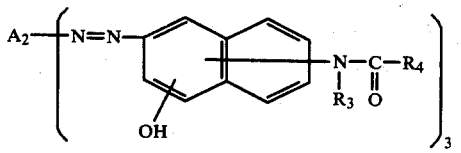

(4)

wherein $R_3$ is hydrogen, substituted or unsubstituted alkyl, substituted or unsubstituted aralkyl, or substituted or unsubstituted aryl; $R_4$ is substituted or unsubstituted aryl; and $A_2$ is a trivalent organic residue.

30. An electrophotographic photosensitive member according to claim 29, wherein said azo pigments are trisazo pigments represented by the formula

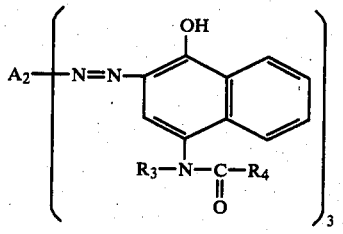

(4)' wherein $R_3$ is hydrogen, substituted or unsubstituted alkyl, substituted or unsubstituted aralkyl, or substituted or unsubstituted aryl; $R_4$ is substituted or unsubstituted aryl; and $A_2$ is a trivalent organic residue.

31. An electrophotographic photosensitive member according to claim 30, wherein said $A_2$ is a nitrogen-containing trivalent hydrocarbon radical having at least two benzene rings.

32. An electrophotographic photosensitive member according to claim 31, wherein said $A_2$ is the following radical:

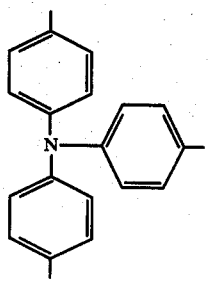

33. An electrophotographic photosensitive member according to claim 30, wherein said $A_2$ is a trivalent hydrocarbon radical having at least two benzene rings and at least one hetero-ring.

34. An electrophotographic photosensitive member according to claim 33, wherein said $A_2$ is a trivalent organic residue selected from the group consisting of

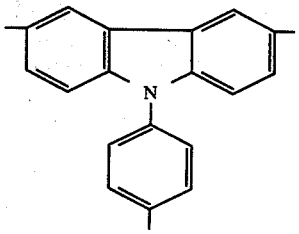

and

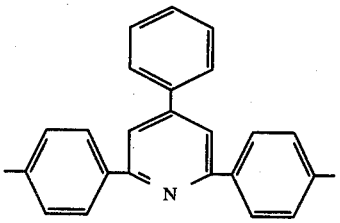

35. An electrophotographic photosensitive member according to claim 1 or 2, wherein said charge generation layer contains binders.

36. An electrophotographic photosensitive member according to claim 35, wherein said charge generation layer contains as a binder at least one kind of high-molecular material selected from the group consisting of poly (vinyl butyral) poly (vinyl acetate), polyesters, polycarbonates, phenoxy resins, acrylic resins, polyacrylamide, polyamides, poly (vinylpyridine), cellulosic resins, urethane resins, epoxy resins, casein, and poly (vinyl alcohol).

37. An electrophotographic photosensitive member according to claim 35, wherein said charge generation layer contains poly (vinyl butyral) as a binder.

38. An electrophotographic photosensitive member according to claim 35, wherein said charge generation layer contains polyester resins as a binder.

39. An electrophotographic photosensitive member according to claim 35, wherein said charge generation layer contains polycarbonates as a binder.

40. An electrophotographic photosensitive member according to claim 1 or 2, wherein said charge transport layer contains at least one compound selected from the group consisting of hydrazones, pyrazolines, diarylalkanes, triarylalkanes, oxadiazoles, anthracenes, and oxazoles.

41. An electrophotographic photosensitive member according to claim 40, wherein said charge transport layer contains at least one pyrazoline compound selected from the group consisting of 1-phenyl-3-(4-N,N-diethylaminostyryl)-5-(4-N,N-diethylaminophenyl) pyrazoline, 1-[pyridyl-(2)-3-(4-N,N-diethylaminostyryl)-5-(4-N,N-diethylaminophenyl) pyrazoline, 1-[quinolyl-(2)]-3-(4-N,N-diethylaminostyryl)-5-(4-N,N-diethylaminophenyl) pyrazoline, 1-[quinolyl-(4)]-3-(4-N,N-diethylaminostyryl)-5-(4-N,N-diethylaminophenyl) pyrazoline, 1-[pyridyl-(3)]-3-(4-N,N-diethylaminostyryl)-5-(4-N,N-diethylaminophenyl) pyrazoline, 1-[3-methoxypyridyl-(2)]-3-(4-N,N-diethylaminostyryl)-5-(4-N,N-diethylaminophenyl) pyrazoline, and 1-[lepidyl-(2)]-3-(4-N,N-diethylaminostyryl)-5-(4-N,N-diethylaminophenyl) pyrazoline.

42. An electrophoto-raphic photosensitive member according to claim 40, wherein said charge transport layer contains at least one hydrazone compound selected from the group consisting of 4-N,N-diethylaminobenzaldehyde-N-N-diphenylhydrazone, and N-N-diphenylhydrazino-3-methylidene-9-ethylcarbazol.

43. An electrophotographic photosensitive member according to claim 40, wherein said charge transport layer contains 2,5-bis-(4-N,N-diethylaminophenyl)-1,3,4oxadiazole.

44. An electrophotographic photosensitive member according to claim 40, wherein said charge transport layer contains at least one anthracene compound selected from the group consisting of 9-styrylanthracene,9-(4-N,N-dimethylaminostyryl)-anthracene, 9-(4-N,N-diethylaminostyryl) anthracene, 9-(4-N,N-dibenzylaminostyryl) anthracene, and 4-bromo-9-(4-N,N-diethylaminostyryl) anthracene.

45. An electrophotographic photosensitive member according to claim 2, wherein said bond layer contains at least one high-molecular material selected from the group consisting of casein, pol (vinyl alcohol), water-soluble ethylene-acrylic acid copolymer, hydroxypropylcellulose, and nitrocellulose.

46. An electrophotographic photosensitive member according to claim 2, wherein said bond layer contains casein.

47. An electrophotographic photosensitive member according to claim 2, wherein said bond layer contains poly (vinyl alcohol).

48. An electrophotographic photosensitive member according to claim 2, said azo pigment is a disazo pigment of the structure

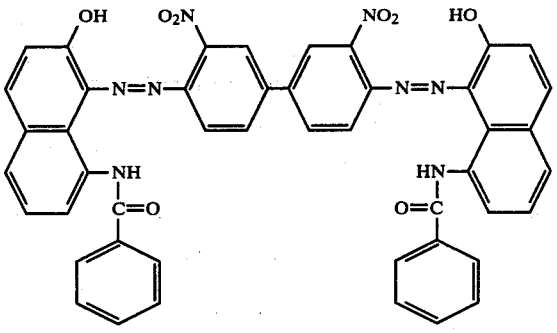

50. An electrophotographic photosensitive member according to claim 1, wherein said azo pigment is a disazo pigment of the structure

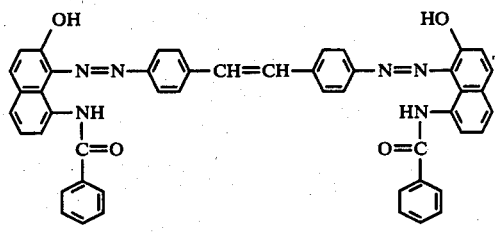

51. An electrophotographic photosensitive member according to claim 1, wherein said azo pigment is a disazo pigment of the structure

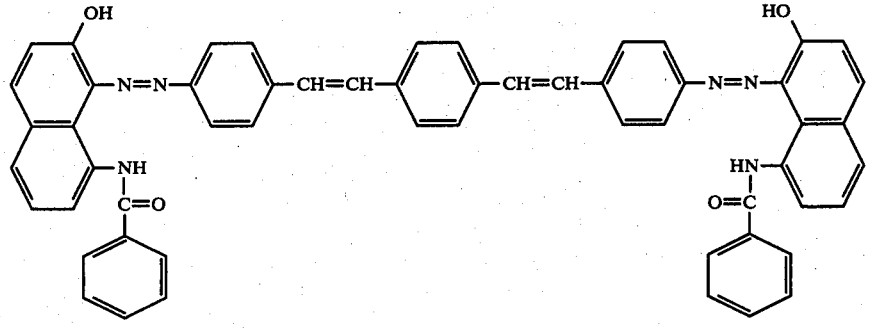

52. An electrophotographic photosensitive member according to claim 1, wherein said azo pigment is a disazo pigment of the structure

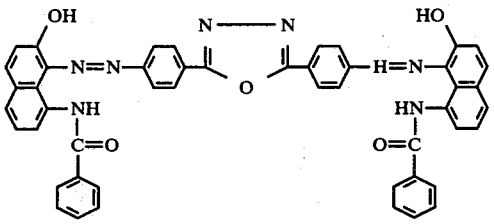

49. An electrophotographic photosensitive member according to claim 1, wherein said azo pigment is a disazo pigment of the structure

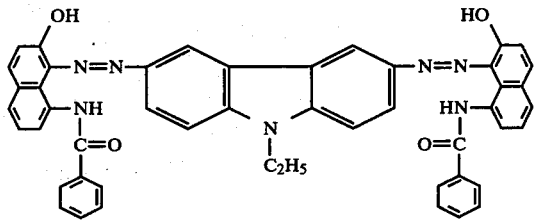

53. An electrophotographic photosensitive member according to claim 1, wherein said azo pigment is a disazo pigment of the structure

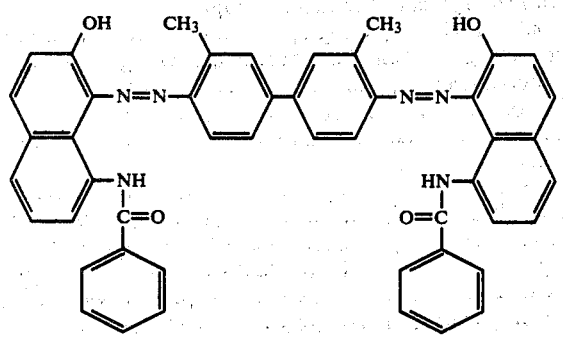

54. An electrophotographic photosensitive member according to claim 1, wherein said azo pigment is a disazo pigment of the structure

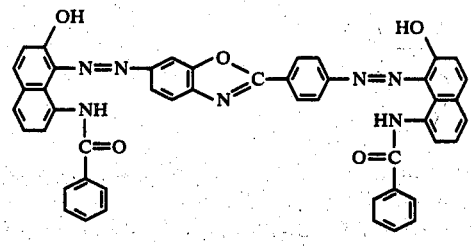

55. An electrophotographic photosensitive member according to claim 1, wherein said azo pigment is a disazo pigment of the structure

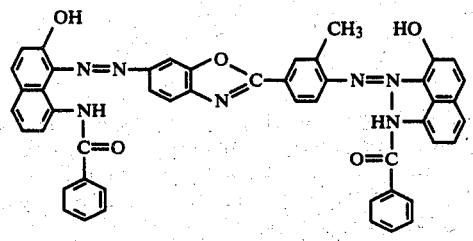

56. An electrophotographic photosensitive member according to claim 1, wherein said azo pigment is a disazo pigment of the structure

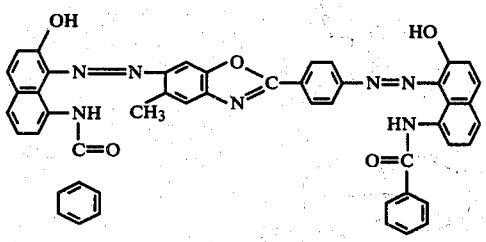

57. An electrophotographic photosensitive member according to claim 1, wherein said azo pigment is a disazo pigment of the structure

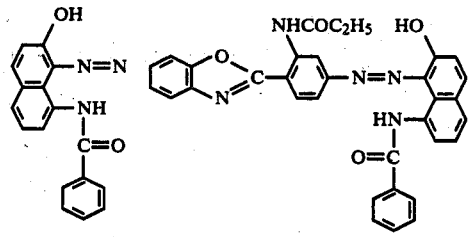

58. An electrophotographic photosensitive member according to claim 1, wherein said azo pigment is a disazo pigment of the structure

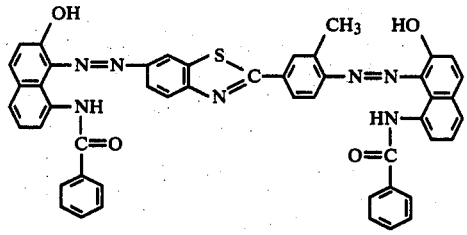

59. An electrophotographic photosensitive member according to claim 1, wherein said azo pigment is a disazo pigment of the structure

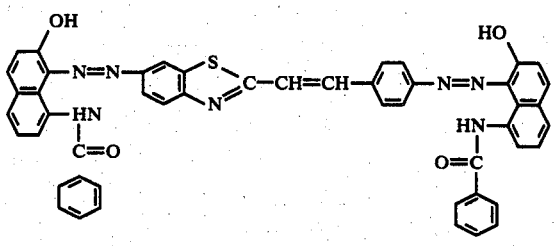

60. An electrophotographic photosensitive member according to claim 1, wherein, said azo pigment is a disazo pigment of the structure

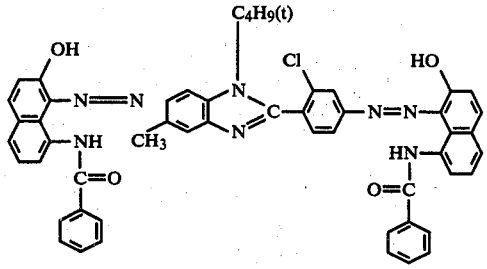

61. An electrophotographic photosensitive member according to claim 1, wherein said azo pigment is a disazo pigment of the structure

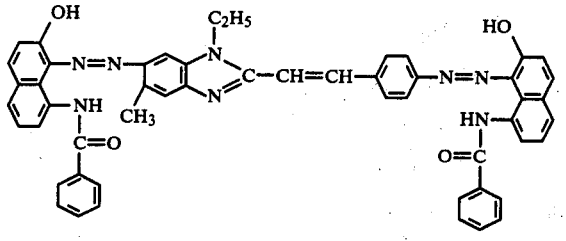

62. An electrophotographic photosensitive member according to claim 1, wherein said azo pigment is disazo pigment of the structure

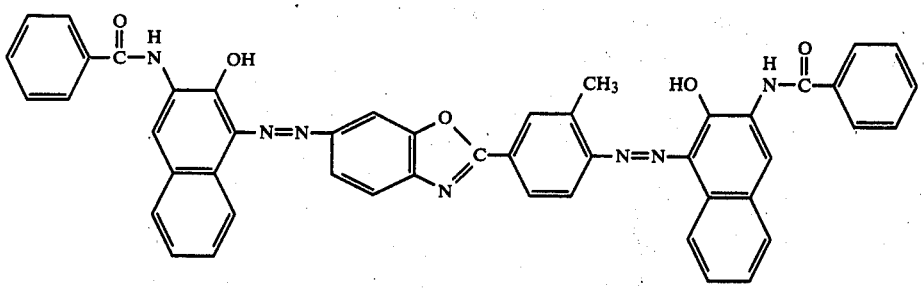

63. An electrophotographic photosensitive member according to claim 1, wherein said azo pigment is a disazo pigment of the structure

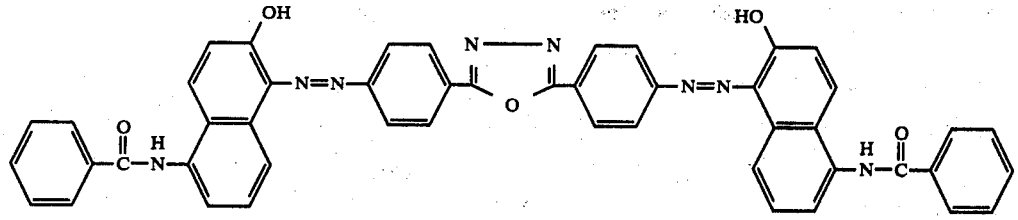

64. An electrophotographic photosensitive member comprising a photosensitive layer comprising a binder, a charge-transport material, and azo pigments having at least one azo group linked to a coupler residue represented by the following formula [1] or [2];

Formula [1]

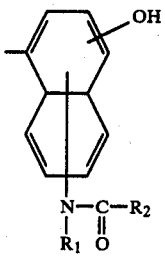

Formula [2]

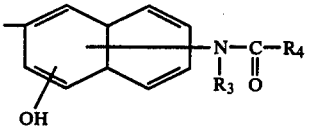

wherein $R_1$ and $R_3$ independently represent hydrogen, substituted or unsubstituted alkyl, substituted or unsubstituted aralkyl, or substituted or unsubstituted aryl, and $R_2$ and $R_4$ independently represent substituted or unsubstituted aryl, and a conductive support.

65. An electrophotographic photosensitive member according to claim 64, wherein said charge transport material is a compound selected from the group consisting of fluorenones, hydrazones, pyrazolines, diarylalkanes, triarylalkanes, oxadiazoles, anthracenes, and oxazoles.

66. An electrophotographic photosensitive member according to claim 65, wherein said charge transport material is a compound selected from the group consisting of 2,5-bis(4-N,N-diethylaminophenyl)-1,3,4-oxadiazole, 2-(4-N,N-diethylaminophenyl)-4-(4-N,N-dimethylaminophenyl)-5-(2-chlorophenyl)oxazole, 2,4,7-trinitrofluorenone, and 4-N,N-diethylaminobenzaldehyde-N,N-diphenylhydrazone.

67. An electrophotographic process which comprises electrically charging an electrophotographic member, said member comprising a photosensitive layer comprising a binder, and azo pigments having at least one azo group linked to a coupler residue represented by the following formula [1] or [2]:

Formula [1]

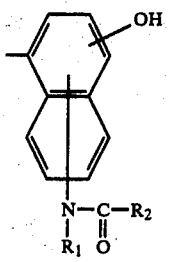

Formula [2]

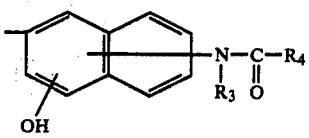

wherein $R_1$ and $R_3$ independently represent hydrogen, substituted or unsubstituted alkyl, substituted or unsubstituted aralkyl, or substituted or unsubstituted aryl, and $R_2$ and $R_4$ independently represent substituted or unsubstituted aryl, and a conductive, support, and exposing said layer to form a latent electrostatic image.

68. An electrophotographic process according to claim 67, wherein said electrophotographic member comprises a conductive support, a charge transport layer, and a charge generation layer containing said azo pigments.

69. An electrophotographic process according to claim 67, wherein said azo pigments are disazo pigments represented by the formula

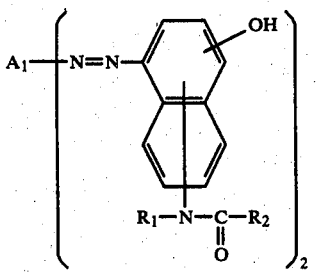

wherein $R_1$ is hydrogen, substituted or unsubstituted alkyl, substituted or unsubstituted aralkyl, or substituted or unsubstituted aryl; $R_2$ is substituted or unsubstituted aryl; and $A_1$ is a divalent organic residue.

70. An electrophotographic process according to claim 67, wherein said azo pigments are trisazo pigments represented by the formula

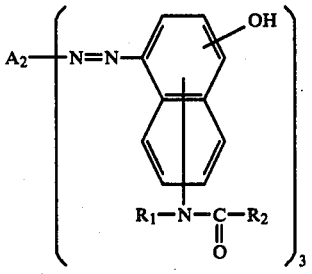

(2)

wherein $R_1$ is hydrogen, substituted or unsubstituted alkyl, substituted or unsubstituted aralkyl, or substituted or unsubstituted aryl; $R_2$ is substituted or unsubstituted aryl; and $A_2$ is a trivalent organic residue.

71. An electrophotographic process according to claim 67, wherein said azo pigments are disazo pigments represented by the formula

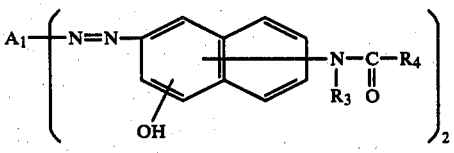

(3)

wherein, $R_3$ is hydrogen, substituted or unsubstituted alkyl, substituted or unsubstituted aralkyl, or substituted or unsubstituted aryl; $R_4$ is substituted or unsubstituted aryl; and $A_1$ is a divalent organic residue.

72. An electrophotographic process according to claim 67, wherein said azo pigments are trisazo pigments represented by the formula

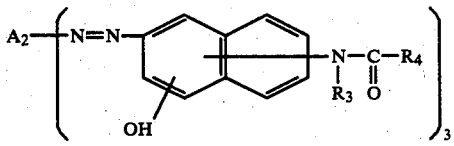

(4)

wherein $R_3$ is hydrogen, substituted or unsubstituted alkyl, substituted or unsubstituted aralkyl, or substituted or unsubstituted aryl; $R_4$ is substituted or unsubstituted aryl; and $A_2$ is a trivalent organic residue.

* * * * *

UNITED STATES PATENT AND TRADEMARK OFFICE

CERTIFICATE OF CORRECTION

PATENT NO. : 4,390,611

DATED : June 28, 1983

INVENTOR(S) : Shozo Ishikawa, et al.

It is certified that error appears in the above-identified patent and that said Letters Patent is hereby corrected as shown below:

In the Abstract, after "of" insert --the--.
Col. 1, line 31, "cahrge" to --charge--.
Col. 1, line 53, "remarkably" to --markedly--.
Col. 2, line 18, "machine" to --machines--.
Col. 2, line 29, "members" to --member--.
Col. 2, line 31, after "problems" delete --,--.
Col. 2, line 33, after "members" delete --,--.
Col. 2, line 51, after "formula" insert --:--.
Col. 2, line 66, after "alkyl" insert --,--.
Col. 3, line 43, "pheny" to --phenyl--.
Col. 4, line 28, "formula" to --formulae--.
Col. 6, line 63, "iso-propyl" to --isopropyl--.
Col. 9, line 33, "case" to --cases--.
Col. 9, line 45, "tickness" to --thickness--.
Col. 9, line 56, "in" to --solution--.
Col. 9, line 58, after "using" insert --a--.
Col. 10, line 16, "usuable" to --usable--.
Col. 12, line 53, after "resin" insert --.--.
Col. 13, line 21, "after" to --afterwards--.
Col. 13, line 37, "contrasts" to --contrast--.
Cols. 13-14, lines 68 and 1, "coating then" to --then coating--.
Col. 14, line 3, "members" to --member--.
Col. 14, line 42, after "for" insert --a--.
Col. 14, line 49, after "for" insert --a--.

UNITED STATES PATENT AND TRADEMARK OFFICE

CERTIFICATE OF CORRECTION

PATENT NO. : 4,390,611

DATED : June 28, 1983

INVENTOR(S) : Shozo Ishikawa, et al.

It is certified that error appears in the above-identified patent and that said Letters Patent is hereby corrected as shown below:

Col. 14, line 57, delete "each".

Col. 15, line 4,

" 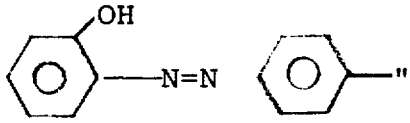 "

to

-- 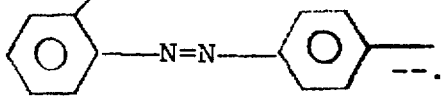 --.

Col. 15, line 16, "during" to --over--.
Col. 16, line 25, after "for" insert --a--.
Col. 16, line 14, "oxasadiazole" to --oxadiazole--.
Col. 16, line 17, "during" to --over--.
Col. 16, line 18, after "for" insert --a--.
Col. 16, line 25, "spending" to --over--.
Col. 16, line 25,after "for" insert --a--.
Col. 16, line 66, "during" to --over--.
Col. 16, line 66, after "for" insert --a--.
Col. 16, line 67, "gives" to --gave--.
Col. 17, line 5, after "for" insert --a--.
Col. 18, line 9, after "to" insert --a--.
Col. 18, line 28, after "aluminum" insert --an--.
Col. 19, line 39, after "aluminum" insert --an--.
Col. 24, line 68, "dying" to --drying--.
Col. 29, line 16,"phostosensitive" to --photosensitive--.
Col. 29, line 59, "disolving" to --dissolving--.

UNITED STATES PATENT AND TRADEMARK OFFICE

CERTIFICATE OF CORRECTION

PATENT NO. : 4,390,611

DATED : June 28, 1983

INVENTOR(S) : Shozo Ishikawa, et al.

It is certified that error appears in the above-identified patent and that said Letters Patent is hereby corrected as shown below:

Col. 30, line 45, after "of" insert --an--.
Col. 31, line 7, after "of" insert --an--.
Col. 31, line 65, after "of" insert --an--.
Col. 32, line 17,"poly carbonate" to --polycarbonate--.
Col. 32, line 28, after "of" insert --an--.
Col. 32, line 66, after "of" insert --an--.
Col. 43, line 51, "dimethylaminiphenyl" second ocurrence --dimethylaminophenyl--.
Col. 44, line 61, after "of" insert a--.
Col. 54, line 66, "electrophoto-raphic" to --electrophotographic--.
Col. 55, line 8, after "4" insert -- - --.
Col. 55, line 20, "pol" to --poly--.

Signed and Sealed this

*Twenty-ninth* Day of *November 1983*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,390,611

DATED : June 28, 1983

INVENTOR(S) : Shozo Ishikawa et al.

It is certified that error appears in the above-identified patent and that said Letters Patent is hereby corrected as shown below:

On the title page insert:

-- /73/ Assignee: Canon Kabushiki Kaisha and Copyer Kabushiki Kaisha, Tokyo, Japan --.

Signed and Sealed this

*Eighteenth* Day of *December 1984*

[SEAL]

*Attest:*

*Attesting Officer*

GERALD J. MOSSINGHOFF

*Commissioner of Patents and Trademarks*